US005268717A

United States Patent [19]

Imaizumi

[11] Patent Number: 5,268,717

[45] Date of Patent: Dec. 7, 1993

[54] IMAGE FORMING APPARATUS AND IMAGE FORMING METHOD

[75] Inventor: Shoji Imaizumi, Shinshiro, Japan

[73] Assignee: Minolta Camera Kabushiki Kaisha, Osaka, Japan

[21] Appl. No.: 749,718

[22] Filed: Aug. 26, 1991

[30] Foreign Application Priority Data

Aug. 27, 1990 [JP] Japan ..... 2-225865

[51] Int. Cl.[5] ..... G03G 15/04

[52] U.S. Cl. ..... 355/244; 355/272; 355/275; 355/326 R

[58] Field of Search ..... 355/202, 244, 326, 327, 355/328, 272, 275; 118/645; 358/450; 346/160, 157

[56] References Cited

U.S. PATENT DOCUMENTS 3,914,043 10/1975 McVeigh ..... 355/328
4,268,184 5/1981 Yajimi et al. ..... 355/51 X
4,862,216 8/1989 Higashi et al. ..... 355/218
5,033,102 7/1991 Nakajima et al. ..... 358/453 X
5,070,371 12/1991 Randell ..... 355/326 X
5,084,760 1/1992 Hashimoto et al. ..... 355/202 X
5,153,645 10/1992 Hasegawa et al. ..... 355/244

FOREIGN PATENT DOCUMENTS 231967 12/1984 Japan ..... 358/450
93463 5/1985 Japan .

*Primary Examiner*—R. L. Moses
*Assistant Examiner*—J. E. Barlow, Jr.
*Attorney, Agent, or Firm*—Burns, Doane, Swecker & Mathis

[57] ABSTRACT

An image forming apparatus selects and combines necessary image sections from a plurality of documents thereby to obtain a combined image on one sheet of paper. The image forming apparatus is provided with an optical scanning system for exposing/scanning a document in relative movement therewith, a lever for setting a reference position to divide the document into a plurality of sections in the scanning direction of the document, a transfer belt for holding an image of each section at every exposure/scanning time, and a transfer charger for transferring the image held by the transfer belt to a paper, each of which is controlled so that the images of a plurality of the sections are combined and transferred at one time to the paper.

10 Claims, 18 Drawing Sheets

IMAGE FORMING APPARATUS AND IMAGE FORMING METHOD

BACKGROUND OF THE INVENTION

1. Field of the Invention

This invention generally relates to an image forming apparatus such as a copying machine or the like, and more particularly, to an image forming apparatus having a function to obtain a combined image from a plurality of documents.

2. Description of Related Art

As one example of performances executed by a copying machine, there is an editing work, whereby necessary parts are extracted from a plurality of documents thereby to edit one image. Editing becomes necessary to obtain a combined image, for instance, when the using copying machine is equipped with various kinds of optional functions. Conventionally, in such case as above to obtain the combined image, copies of images from a plurality of documents are cut and bonded on a board sheet, or a desired image is extracted in a combining mode.

However, it takes much trouble to copy the documents once, cut and bond the copied images on the board sheet and then copy the board sheet again, resulting in a long time of work and degradation of the image quality every time copying is performed.

On the other hand, editing according to the combining mode can prevent degradation of the image quality, but requires additional devices corresponding to the desired image. The manipulation of the apparatus becomes therefore complicated. At the same time, the structure and cost of the apparatus is increased. For example, an editor and a combining device are necessitated to effect the combining mode in a general monocolor copying machine. The editor is used to take out necessary parts of the document by inputting coordinates of four points in a scanning direction of the document and in a direction orthogonal to the scanning direction and taking out an image of the part enclosed by the four points or the part except the enclosed part. It is troublesome to input the coordinates. The combining device circulates a paper to which an image is once transferred and fixed so as to transfer another image again to the paper. The combining device becomes inevitably bulky in structure. Moreover, although a full-color copying machine using an intermediate transfer body does not require the combining device since a combined image can be formed on the intermediate transfer body, the editor is indispensable to take out the necessary image, thereby giving rise to the same problems as described above.

SUMMARY OF THE INVENTION

An image forming apparatus according to this invention is provided with scanning means for exposing/scanning a document in relative movement with the document, indicating means for indicating a reference line to divide the document in a plurality of sections in the scanning direction of the scanning means, image holding means for holding an image of the scanned document, transfer means for transferring the held image to a transfer object, and control means for controlling the scanning means, image holding means and transfer means so as to transfer a plurality of images held by the holding means to the transfer object all at once. A lever moving in the scanning direction is used for the indicating means to indicate the image section.

In the combining mode of this invention, when the lever is moved to a desired position in the scanning direction, a section from a front end of the image to the position of the lever is set as a first exposing/scanning area of the document and the image in the set first area is held by the image holding means. Thereafter, a section from the position of the lever to a rear end of the image is set as a second exposing/scanning area of the document, and the image in the set second area is held by the image holding means. An image obtained by combining the two images at the boundary where the lever is positioned is held by the image holding means and transferred to the transfer object, e.g., a copying paper or the like by the transfer means.

An object of this invention is to provide an image forming apparatus capable of combining images through simple manipulation.

Another object of this invention is to provide an image forming apparatus capable of combining images in a simple structure.

The above and further objects and features of the invention will more fully be apparent from the following detailed description with accompanying drawings.

DESCRIPTION OF THE PREFERRED EMBODIMENTS

This invention will be discussed in detail taken in conjunction with preferred embodiments thereof with referring to the accompanying drawings.

Figure 1:
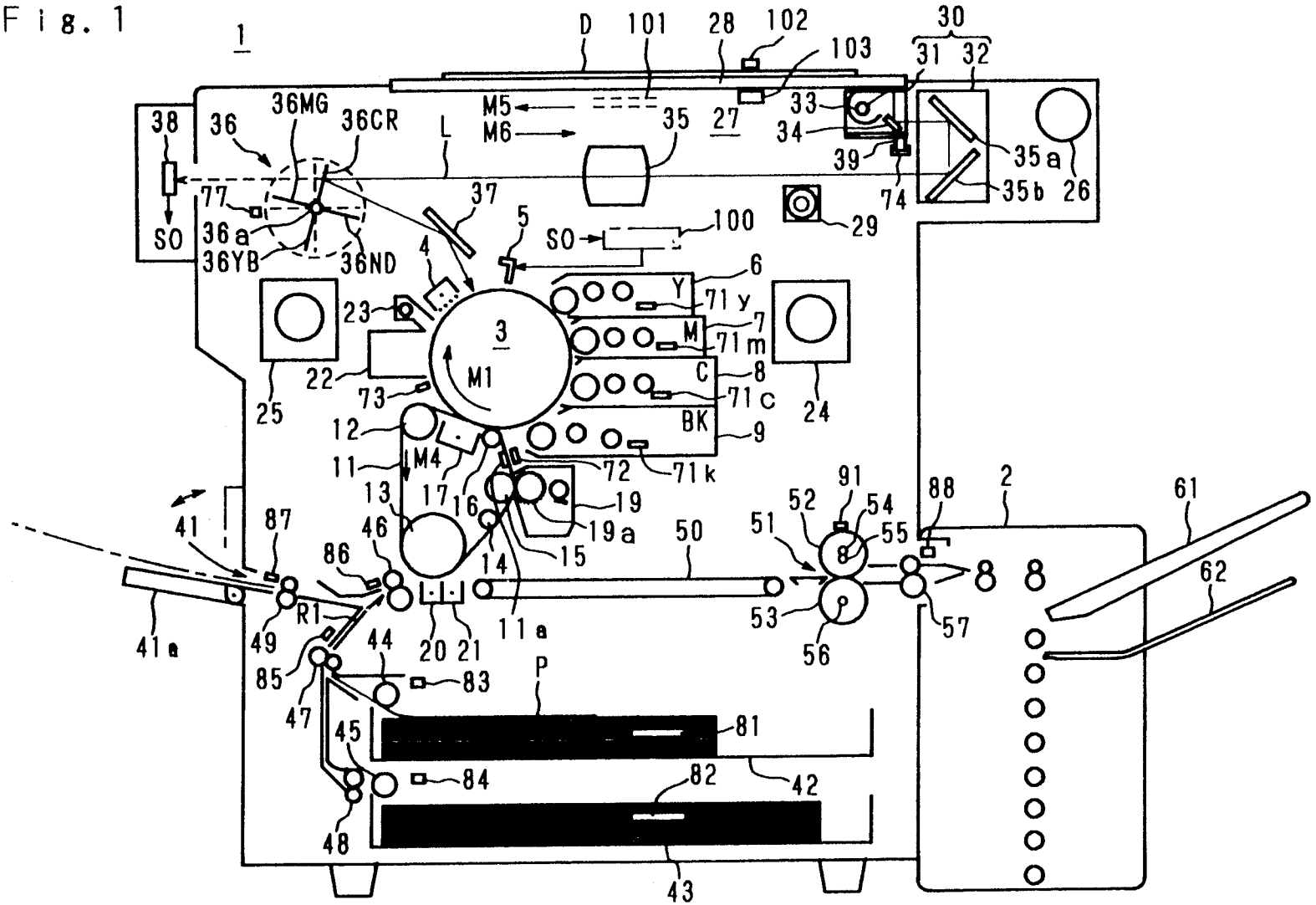
FIG. 1 is a longitudinal cross sectional view showing the structure of an analog full-color copying machine embodied by this invention.

Referring to FIG. 1 showing an analog full-color copying machine 1 according to one embodiment of the present invention, a photosensitive drum 3 is provided relatively upper leftward of the center of the copying machine 1 to be rotatable in a clockwise direction (direction of an arrow M1). An electrostatic charger 4, an editing eraser 5, developers 6–9, a transfer belt 11, a cleaning device 22 and a main eraser 23 are mounted in the periphery of the photosensitive drum 3.

A photosensitive layer is formed on the surface of the photosensitive drum 3. When the photosensitive drum 3 passes the main eraser 23 and electrostatic charger 4, the surface of the drum is uniformly charged and exposed to form a latent image by an optical system 27 including an optical scanning device. The editing eraser 5 is utilized for forming a full-color image, and comprised of an LED array having many LEDs aligned in a holder provided along an axial direction of the photosensitive drum 3. The editing eraser 5 is capable of partly deleting the latent image on the photosensitive drum 3. The developers 6–9 contain developing materials of respective mixture of toners, namely, yellow (Y), mazenta (M), cyan (C), black (CK) and carriers. The concentration of each toner is controlled by a toner concentration sensor 71*y*, 71*m*, 71*c* or 71*k*. It is to be noted that the developers 6–9 are not necessarily fixedly mounted on the periphery of the photosensitive drum 3, but may be formed integrally into one body to be movable in an up-and-down direction. That is, it is enough that toners of different colors can be selectively supplied to the photosensitive drum 3.

The transfer belt 11 temporarily holds a toner image developed onto the photosensitive drum 3 by the developers 6–9 before the toner image is transferred to a paper P (secondary transfer). The transfer belt 11 is hung around a plurality of rollers 12–16 and kept always in contact with the photosensitive drum 3. Moreover, the transfer belt 11 is rotatable in a counterclockwise direction (direction of an arrow M4). A transfer charger 17 is disposed inside the transfer belt 11 to transfer the toner image from the photosensitive drum 3 onto the transfer belt 11 (primary transfer). Outside the transfer belt 11, there are provided a transfer charger 20 for the secondary transfer, a separation charger 21 for separating the paper P from the transfer belt 11 and a belt cleaner 19 having a fur brush 19*a* to clean the outer surface of the transfer belt 11. The fur brush 19*a* is selectively brought in pressed contact with (at the cleaning time) and detached from the transfer belt 11. The angular position of the transfer belt 11 during rotation is known by a belt mark 11*a*. Between rollers 15 and 16, a mark sensor 72 for detecting the angular position of the transfer belt 11 during rotation is fixedly mounted.

A document glass 28 is placed on the upper surface of the copying machine 1. A document size detecting device 101 which is built in at the inner side of the copying machine 1 immediately below the document glass 28 moves in a manner not to hinder scanning to detect the size of a document D.

A simultaneous lever 102 is movable along the moving direction of a scanner 30 at the front side of the upper surface of the document glass 28. An image section to be scanned in the combining copy mode which will be described later is set by the simultaneous lever 102. The simultaneous lever 102 interlocks with a simultaneous switch 103 which is provided confronting to the simultaneous lever 102 with the document glass 28 sandwiched therebetween. The position of the simultaneous switch 103 is detected at a pre-scanning time in the combining copy mode, according to which the combining copy mode is executed.

The optical system 27 in the upper part of the copying machine 1 is constituted by the scanner 30 which is reciprocable in directions of an arrow M5 (forwarding direction) and an arrow M6 (returning direction) below the document glass 28, a main lens whose position is adjusted in correspondence to the copying magnification, a filter selecting device 36 for the color separation exposure, a fixed mirror 37 which guides a scanning light L reflected by a mirror mounted in the filter selecting device 36 to the photosensitive drum 3 and a color image sensor 38 which receives the scanning light L having passed through the mirror of the filter selecting device 36, etc. The optical system 27 scans the document D when the scanner 30 moves in the forwarding direction, thereby to expose the photosensitive drum 3.

The scanner 30 is comprised of a first slider 31 with an exposure lamp 33, a mirror 34 and a detecting piece 39 and, a second slider 32 with mirrors 35*a*, 35*b*. During the scanning time of the document D, the first slider 31 is forwarded at a speed V/n (V is a peripheral velocity of the photosensitive drum 3 and n is the copying magnification), while the second slider 32 is driven forward by a scan motor 29 at a speed V/2n. A home position which is the stopping position of the scanner 30 is detected when a home switch 74 constituted by a photosensor is shut off by the detecting piece 39 and turned ON. The filter selecting device 36 has a half mirror 36ND (the ratio of the transmission and reflection is 6:4) and three filter mirrors 36YB, 36MG, 36CR arranged radially around a shaft 36*a* with 90 degrees from each other. The mirrors are selectively switched through rotation. Each of the filter mirrors 36YB, 36MG, 36CR is a unit of a mirror and a filter obtained by vapor-depositing a color separation filter of blue (B), green (G), red (R) to a mirror surface, and is used corresponding to the respective color of toners, i.e., Y, M, C.

During exposing and scanning for formation of an image, a reflecting surface of the selected mirror is so positioned as to incline approximately 10 degrees in the clockwise direction to a vertical surface, thereby the scanning light L is guided to an exposing point of the photosensitive drum 3. Moreover, during preparatory scanning to read the image of the document D prior to the above exposing and scanning for image formation, the half mirror 36ND is selected and positioned to be orthogonal to a direction of incidence of the scanning light L so as to improve the image forming ability of the color image sensor 38. A rotating position detecting sensor 77 determines the home position of the filter selecting device 36. FIG. 1 illustrates the state where the filter mirror 36CR is selected and positioned. In the following description, the half mirror 36ND and filter mirrors 36YB, 36MG, 36CR will sometimes be denoted respectively as an ND filter, a B filter, a G filter, an R filter in relation to the color separation characteristics thereof. The color image sensor 38 is formed of three arrays of many photodetecting elements aligned in a main scanning direction. The R, G, B filters are provided in the first, second and third arrays, respectively. One photodetecting element corresponds to one pixel of the image of the document. From each photodetecting element, a photoelectric conversion signal SO corresponding to the intensity of the reflecting light to one color of pixels is fed to an image processing part 100 as a document information.

Meanwhile, in the lower part of the copying machine 1, there are provided an upper paper cassette 42 and a lower paper cassette 43 where papers P are accommodated. A paper feed port 41 is opened at the left side face of the copying machine 1 through which the paper P is manually fed by opening a door 41*a*. These paper cassettes 42, 43 and paper feed port 41 are alternatively used. The paper cassettes 42, 43 are equipped with pickup rollers 44, 45 for taking out the papers P one by one, paper size sensors 81, 82 to detect the size of the papers P and paper empty sensors 83, 84 to detect the shortage of the papers P, respectively. A sensor 87 provided at the paper feed port 41 detects when the paper P is inserted.

The paper P drawn out from the paper cassette 42 is transferred to a timing roller 46 by a paper feed roller 47, and the paper P drawn out from the paper cassette 43 is guided by the paper feed rollers 48, 47 to the timing roller 46. The paper P stands by at the timing roller 46. On the other hand, the paper inserted through the paper feed port 41 is carried to the timing roller 46 by a feed roller 49. The presence or absence of the paper P at a feed route R1 between the paper feed roller 47 and timing roller 46 is detected by a paper sensor 85 provided in the vicinity of the paper feed roller 47. Moreover, a timing sensor 86 in the vicinity of the timing roller 46 detects a front end of the passing paper P. The waiting paper P is transported through rotation of the timing roller 46 in synchronism with the transfer belt 11, and a toner image is transferred to the paper P from the transfer belt 11 at the transfer position (secondary transfer). Thereafter, the paper P is sent to a fixing unit 51 by a conveyor belt 50 of the straight length corresponding to papers of A4 size.

The fixing unit 51 is constituted by an upper roller 52 with two heater lamps 54, 55, a lower roller 53 with one heater lamp 56 and a temperature sensor 91 formed of a thermister arranged in the vicinity of the upper roller 52, and the like. The toner image is melted and fixed to the paper P at the fixing unit 51. The paper P is, after a desired copying image is formed thereon through fixing of the toner image, sent to a sorter 2 by a discharger roller 57 which has a discharge sensor 88 arranged in the vicinity thereof to detect a rear end of the passing paper P, to be discharged to a storing tray 61 or a sorting bin 62.

In FIG. 1, references 24, 25 and 26 respectively represent a main motor for driving each part related mainly to the supply and conveyance of the paper P, a PC motor for driving the photosensitive drum 3 and transfer belt 11 or the like, and a cooling fan.

In the copying machine 1 of the above-described structure, it is possible to obtain a mono-color copying image by toners of a single color Y, M, C or BK, a synthetic mono-color copying image R (Y and M), G(Y and C) or B(M and C) obtained by overlapping toner images of two different colors, among the three primary colors Y, M, C, and a full-color copying image obtained by overlapping toner images of three primary colors.

In order to form the mono-color image and synthetic mono-color image, the half mirror 36ND is used to expose and scan the document D and a latent image formed on the photosensitive drum 3 is developed by one of the developers 6–9 other corresponding to the designated color, and the toner image is transferred to the transfer belt 11. Further, for obtaining the synthetic mono-color copying image, the same document D is exposed and scanned again by the half mirror 35ND, and the toner image developed by a different developer 6–9 than the previous one is transferred onto the transfer belt 11, whereby the toner images of two colors are overlapped on the transfer belt 11. On the other hand, in order to form the full-color image, toners of four colors in which BK being added to Y, M, C are sequentially used to enhance the reproducibility or reality of the black portion of the image. In other words, the same document D is exposed and scanned four times. The B, G, R, ND filters and developers 6–9 are selectively switched every scanning time and the latent images subjected to color separation from the document D are formed and developed on the photosensitive drum 3. The toner images are sequentially transferred to the transfer belt 11, and overlapped one after another thereon.

It is necessary to transfer the toner images onto the same position of the transfer belt 11 when the toner images are overlapped (referred to as a multiple transfer hereinafter). Therefore, according to the copying machine 1 of the embodiment, it is so arranged that the scanner 30 is started to be driven when the belt mark 11*a* of the transfer belt 11 is detected, thereby controlling the starting timing of formation of the latent images on the photosensitive drum 3.

When the full-color image is formed, the image of the document D is distinguished between a color image part including colored portions and a monochrome image part composed only of uncolored portions at the preparatory scanning. Accordingly, when images of each toner, Y, M, C are formed, the latent image corresponding to the monochrome image part is erased by the editing eraser 5 prior to the development. When the image of BK toner is formed, in contrast, the latent image corresponding to the color image part is erased before development. That is, the color image part is reproduced by the multiple transfer of each toner, Y, M, C and the monochrome image part is reproduced by only the BK toner. A clear copying image can be obtained in this manner as above without minute shift of colors from a character which is generally expressed in black or an image with small line width such as a line drawing, etc. and at the same time, it becomes possible to reproduce the natural color of a multi-color image, for example, a color picture.

Figure 2:
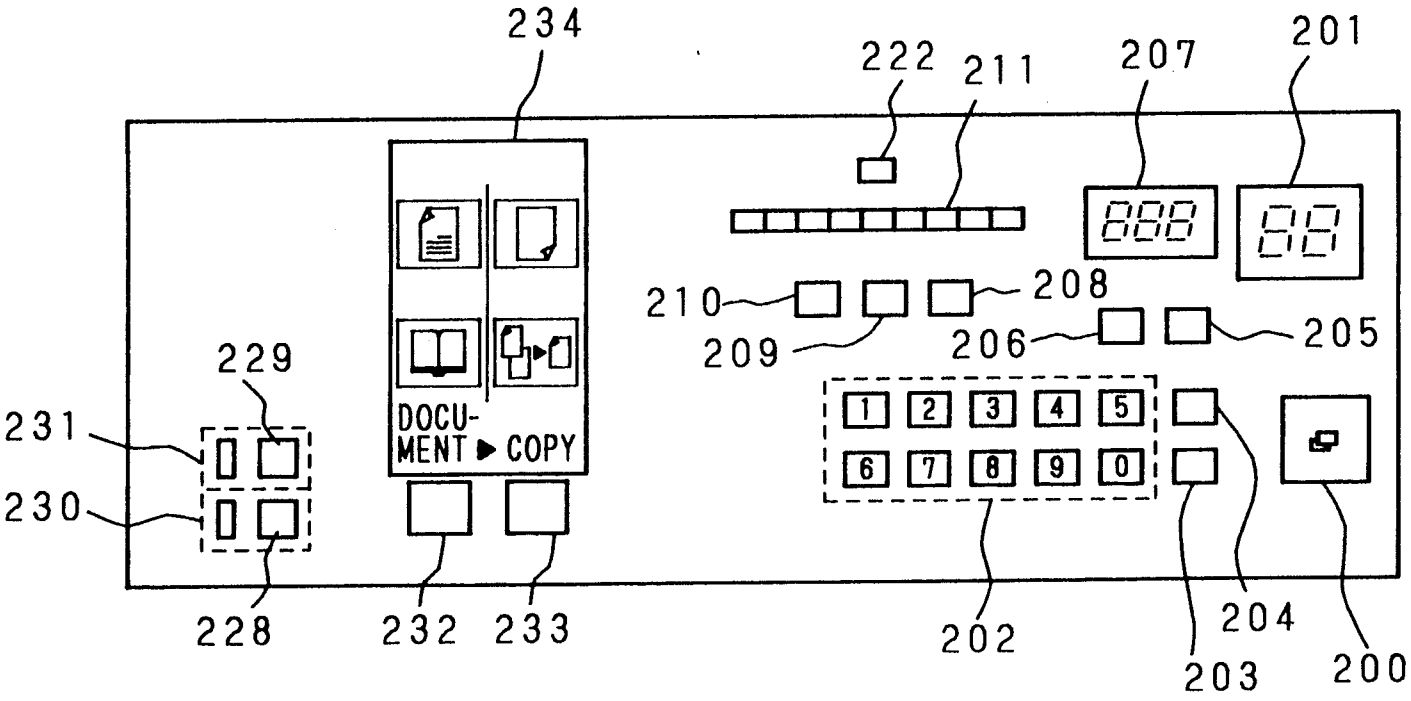
FIG. 2 is a plan view showing the structure of an operating panel.

An operating panel is mounted at the front side on the upper surface of the copying machine 1. FIG. 2 is a plan view of the layout of the operating panel. A print switch 200 is provided at the lower right part of the operating panel to start copying. A clear spot key 203, an interruption key 204 and a ten key 202 are at the left side of the print switch 200. The ten key 202 is used to input various kinds of information, e.g., the number of papers to be copied and the like. An LED 201 of seven segments is provided at the upper portion of the print switch 200 to indicate the number of papers in copying progress, with an LED 207 of seven segments being provided at the belt side to indicate the copying magnification. Besides, an up key 205 and a down key 206 for setting the magnification, an automatic exposure key 209, a manual up key 208 and manual down key 210 for manually changing the exposure amount, an exposure level indicating LED 211 and an automatic exposure selection indicating LED 222 are provided at the upper portion of the ten key 202.

A mode selection key and a mode indicating LED are mounted at the left side of the operating panel. Concretely, there are a selection key 228 to select a monochrome copy mode, an indicating LED 230 to indicate when the monochrome copy mode is selected, a selection key 229 t select a full-color copy mode, an indicating LED 231 to indicate the selection of the full-color copy mode, a document selection button 232 to select a one-face or booktype document, a copy mode selection button 233 to set a one-face or a synthetic copy mode and an indicating part 234. If the combining copy mode is desired, the document selection button 232 should be pressed to select a one-face and the copy mode selection button 233 is switched to select combining the copy mode. Consequently, a copy combining two documents can be obtained.

Figure 3:
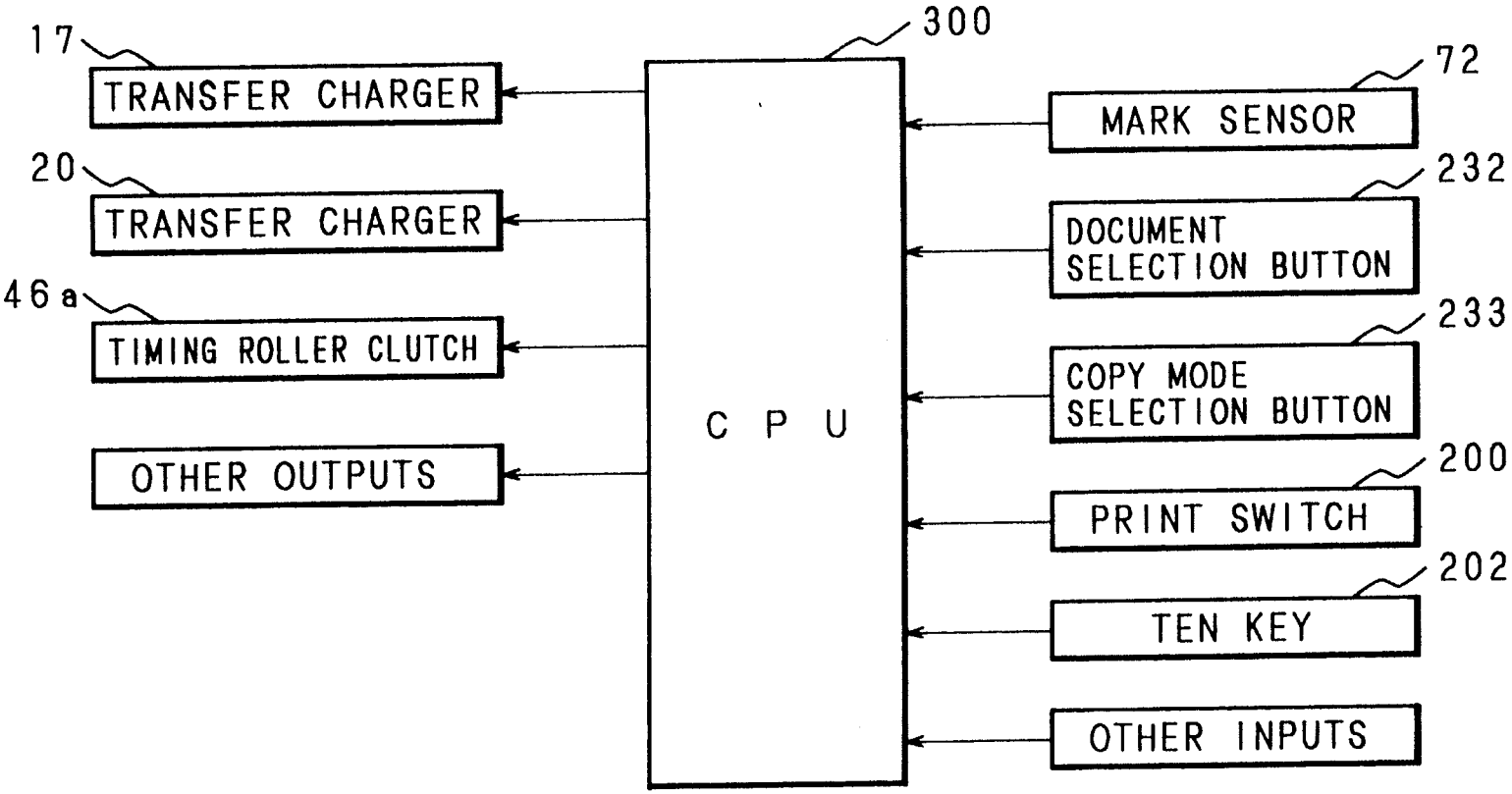
FIG. 3 is a structural block diagram of a controlling system.

FIG. 3 is a block diagram showing the structure of a control system to control the copying machine 1. The copying machine 1 is controlled by a microcomputer (referred to as a CPU hereinafter) 300. Signals from a mark sensor 72, print switch 200, ten key 202, document selection button 232, copy mode selection button 233 and the other key inputs and various kinds of detecting signals are input to the CPU 300. In response to the input signals, the CPU 300 generates an output signal to the transfer chargers 17, 20, a clutch 46*a* of the timing roller 46 and the other elements and devices, thereby to control the same.

The copying machine 1 operates in the manner as follows.

Figure 4:
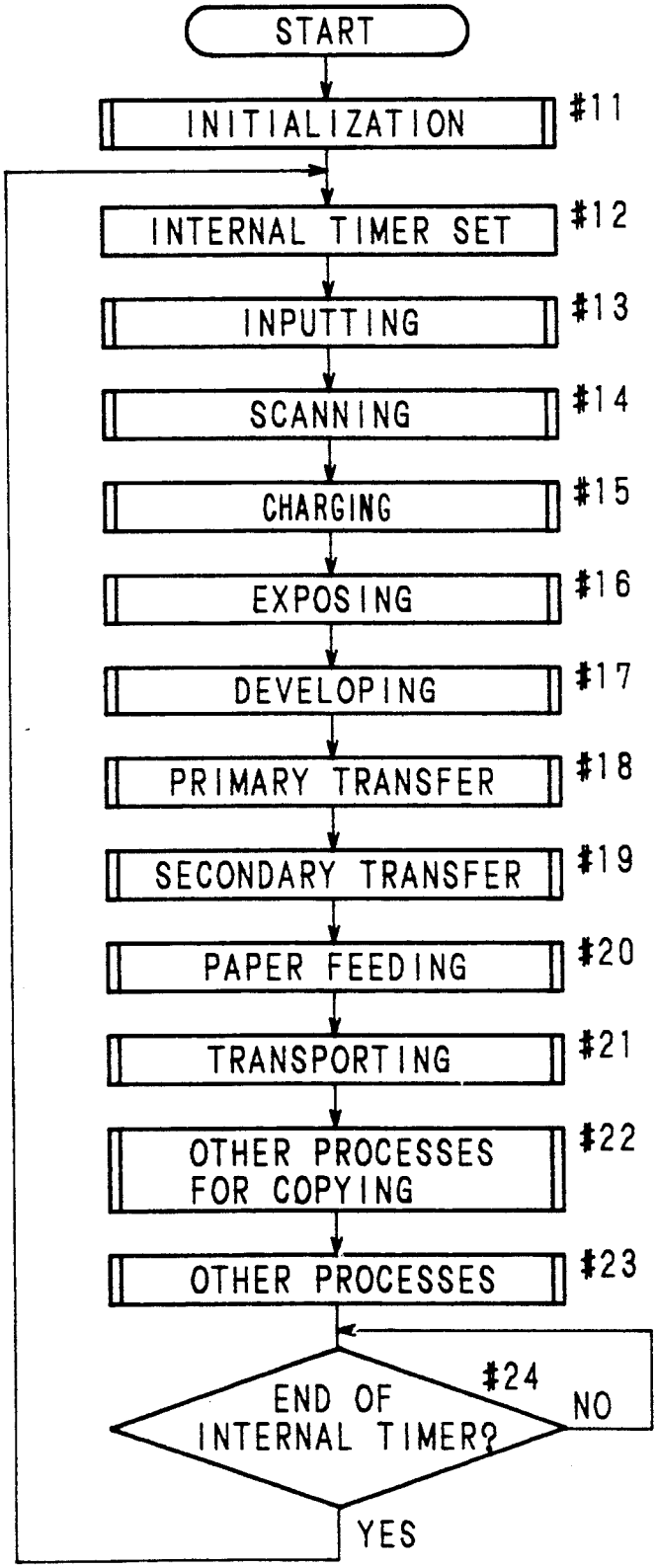
FIG. 4 is a flow chart of a main routine of a CPU.

Referring to a flow chart of FIG. 4 showing a main routine of the CPU 300, when the power switch is turned ON to start the program, an internal RAM of the CPU 300 is cleared and a register and a timer, etc. are initialized (step #11). The inner timer is set to determine the length of one routine of the CPU 300 (step #12). Then, signals corresponding to key inputs through the operating panel and various sensors are processed (step #13), and necessary procedures for steps #14–#22 are performed in accordance with the result of step #13.

First, the scanning process at the scanning time and returning time of the scanner 30 is carried out (step #14). A grid voltage of the electrostatic charger 4 and the ON/OFF timing of the outputs thereof are controlled in the charging process in order to charge the photosensitive drum 3 (step #15). An output voltage of the exposure lamp 33 and the lighting timing thereof are controlled to expose and scan a document in the exposing process (step #16). Then, the developer 6-9 of the color designated in the developing process is driven or stopped, toners are supplied and the shortage of toners is detected, etc. (step #17). After completing the development, the transfer charger 17 is controlled to be turned ON/OFF so that a toner image on the photosensitive drum 3 is transferred onto the transfer belt 11 in the primary transfer process (step #18). Then, the transfer charger 20 is controlled to be turned ON/OFF so that the toner image transferred onto the transfer belt 11 is transferred to the paper P in the secondary transfer process (step #19).

The pickup roller 44, 45 or 49 of the paper cassette 42, 43 or paper feed port 41 is alternatively selected in the paper feeding process, thereby the paper P is supplied (step #20). The paper P is sequentially transported through ON/OFF control of the timing roller 46, paper feed rollers 47, 48 and conveyor belt 50, etc. in the transporting process (step #21). Subsequently, procedures necessary for copying other than those in the foregoing steps, for example, cleaning process, side erasing process, main erasing process and the like are conducted (step #22). Other procedures not directly related to the copy operation, such as temperature control of the fixing unit 51, display of LED on the operating panel and so on, are conducted (step #23).

Thereafter, it is checked whether the inner timer is finished (step #24). The flow is not returned to the step #12 until the inner timer is complete. The procedures in the steps #12–#23 are repeated for a fixed term until the power supply is cut.

Before the details of the aforementioned procedures, the setting time of the timer will be explained below.

A time T0 is a time necessary for the transfer belt 11 to rotate one round. A time T1 is a time necessary for the scanner 30 to move from a front end of image to the position of simultaneous lever 102, and a time T2 is a time necessary for the scanner 30 to move from the position of simultaneous lever 102 to a rear end of image. Moreover, a timer T3 is required for the copying section to pass through each procedure. An equation T3=T1+T2 is held. Moreover, times t2, t3, t4, t5, t6 represent respectively moving times from the charging point to the exposing point, from the exposing point to the developing point, from the exposing point to the primary transfer point, from the primary transfer point to the secondary transfer point and a time expressed by t5 (moving time of the paper P from the timing roller 46 to the secondary transfer point).

Figure 5A:
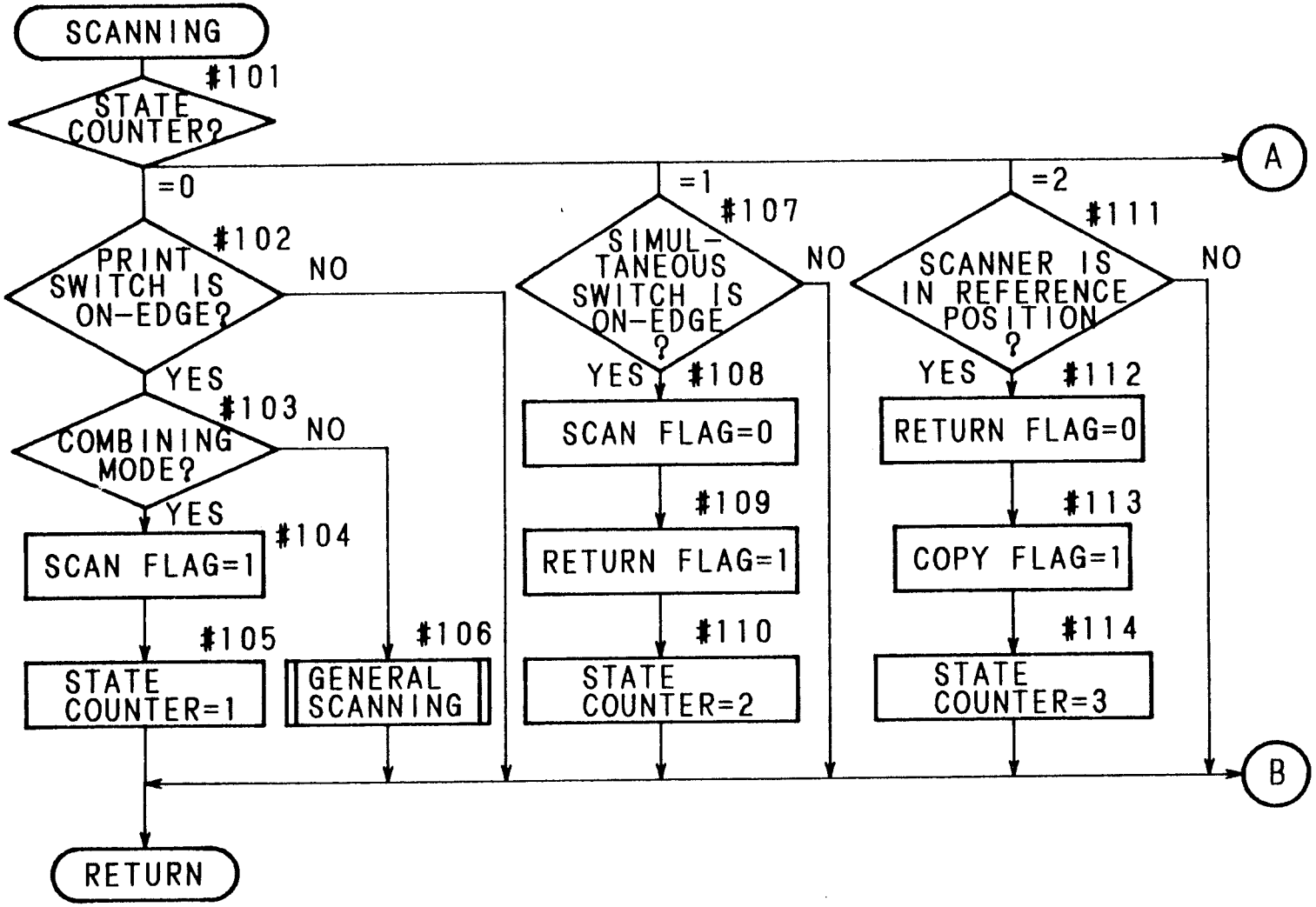
FIG. 5(*a*) and (*b*) are flow charts showing the content of the scanning process of FIG. 4.
Figure 5B:
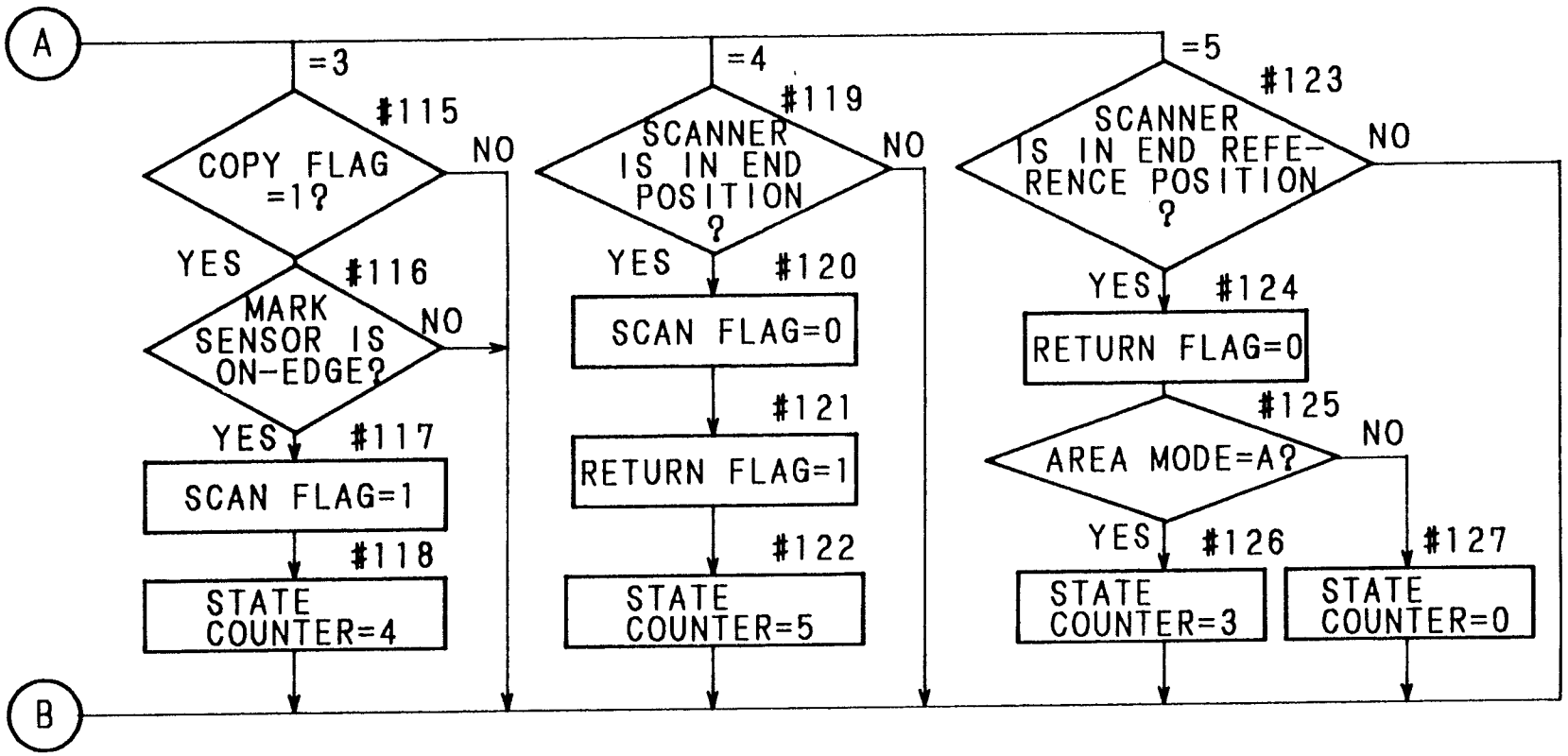

FIG. 5(*a*), (*b*) are flow charts showing the content of the scanning process in the step #14. In the first place, the value of the state counter (initial value 0) indicative of the controlling state is checked (step #101). When the state counter indicates 0, it is checked whether the print switch 200 is on-edge, namely, whether the print switch 200 is turned ON (step #102). In the case where the print switch 200 is on-edge, it is discriminated whether a combining copy mode is selected by pressing the document mode selection button 232 and copy mode selection button 233 (step #103). When the combining copy mode is selected, a scan flag is set to 1, thereby starting pre-scanning (step #104). The pre-scanning is aimed to determine the time for the timer T1 through detection of the position of the simultaneous lever 102 by the simultaneous switch 103 in the combining mode. Then, the state counter is set to 1 (step #105). The flow is once returned to the main routine, and a procedure when the state counter is 1 is performed at a next routine. In the case where the print switch 200 is not on-edge in the step #102, nothing is processed, thereby returning the flow to the main routine. Moreover, if the combining copy mode is not selected in the step #103, general scanning process is carried out (step #106) to return the flow to the main routine. When the state counter shows 1, it is detected whether or not the simultaneous switch 103 is on-edge, i.e., whether the scanner 30 passes the simultaneous lever 102 (step #107). If the simultaneous switch 103 is not on-edge, the flow returns to the main routine. On the other hand, if the simultaneous switch 103 is on-edge, the scan flag is reset to 0, thereby stopping the scanner 30 (step #108) and setting the return flag to 1 to return the scanner 30 (step #109). After the state counter is set to 2 (step #110), the flow is returned to the main routine once. Then, a procedure when the state counter is 2 is carried out at a next routine. When the state counter is 2, the scanner 30 detects the home switch 74 to check whether the scanner 30 is returned to the reference position (step #111). If the scanner 30 is not returned to the reference position, the flow is moved back to the main routine. And, if the scanner is returned to the reference position, the return flag is set to 0, stopping the pre-scanning (step #112). The copy flag is set to 1 (step #113) and the state counter is set to 3 (step #114). Thus, the flow goes back to the main routine.

At a next routine, when the state counter is 3, the state of the copy flag and mark sensor 72 is checked (steps #115, #116). When the copy flag is 1 and mark sensor 72 is on-edge, the scan flag is set to 1 to start scanning for the first sheet of the document (step #117). Thereafter, the state counter is set to 4 (step #118), with the flow once returning to the main routine. When the copy flag is 0 and the mark sensor 72 is not one-edge, nothing is conducted and the flow is returned to the main routine. When the state counter is 4, it is checked whether the scanner 30 has reached the scan end position (step #119). Although the flow moves to the main routine if the scanner 30 does not reach the scan end position, the scan flag is reset to 0 when the scanner 30 has reached the scan end position, with stopping the scanner 30 (step #120). Subsequently, the return flag is set to 1 so that the scanner 30 is moved back to the reference position (step #121). The state counter is set to 5 (step #122), when the flow is in turn returned to the main routine. At a next routine, a procedure when the state counter is 5 is performed. Specifically, when the state counter is 5, it is checked whether the home switch 74 is on-edge, i.e., whether the scanner 30 has reached the reference position (step #123). In the case where the scanner 30 has not reached the reference position, the flow is sent back to the main routine. When the scanner 30 has reached the reference position, the return a flag is reset to 0 to terminate returning of the scanner 30 (step #124). The area mode is checked as to whether or not it is A (step #125). The area mode A referred to above indicates a section from a front end of the image to the position of the simultaneous lever 102 of the two image sections divided in the combining mode, while the area mode B represents a section from the position of the simultaneous lever 102 to a rear end of the image. When the area mode is A, the state counter is set to 3 and the area B is scanned (step #126). On the contrary, if the area mode is not A, the state counter is reset to 0 (step #127) thereby to return the flow to the main routine.

Figure 6A:
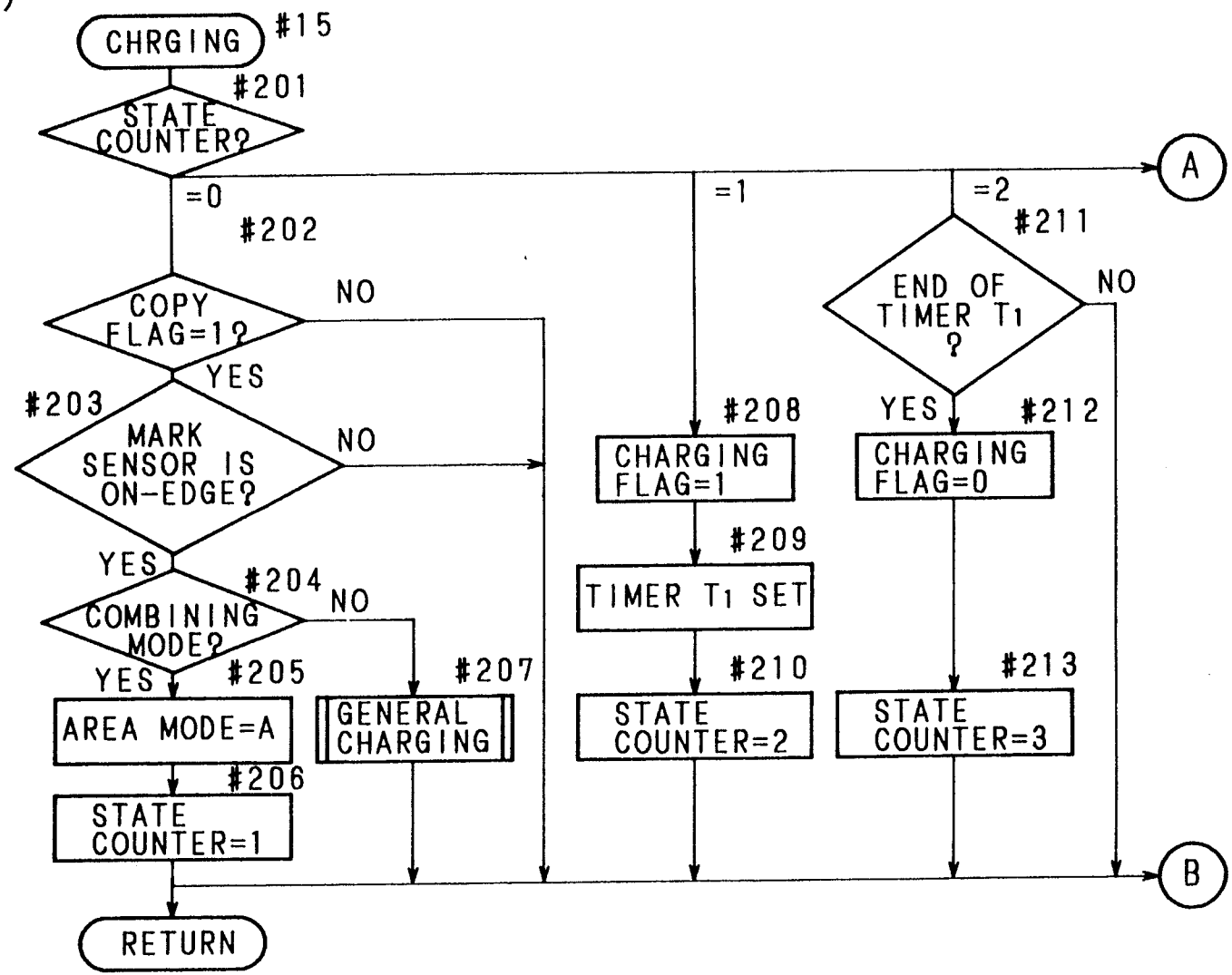
FIG. 6(*a*) and (*b*) are flow charts showing the content of the charging process of FIG. 4.
Figure 6B:
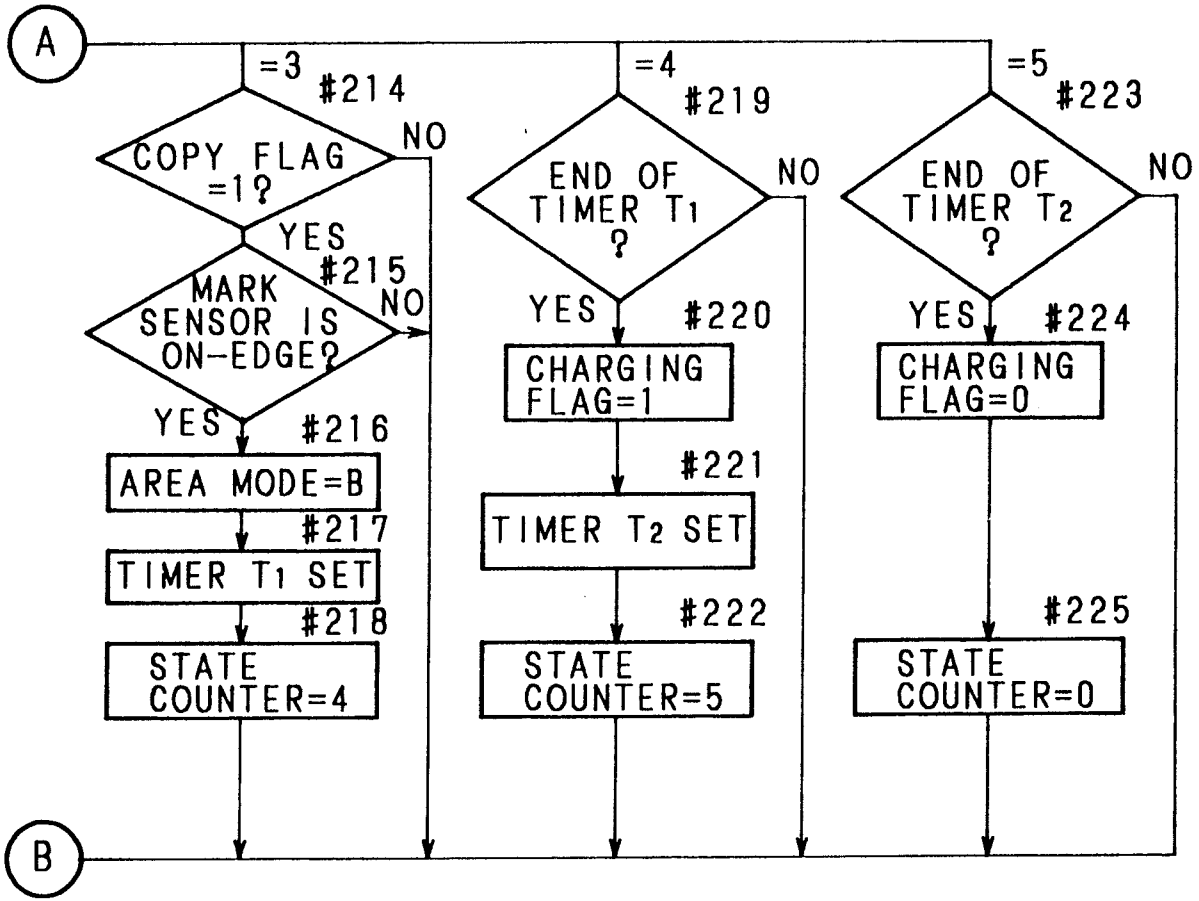

FIGS. 6(*a*), (*b*) are flow charts showing the content of the charging process in the step #15. The value of the state counter (initial value 0) indicating the controlling state is checked first (#201). When the state counter is 0, it is detected whether the copy flag is 1 or not, namely, whether copying is in progress or not (step #202). Then, when the copy flag is 1, it is checked whether the mark sensor 72 is on-edge, that is, whether the belt mark 11*a* of the transfer belt 11 has passed the mark sensor 72 (step #203). If it is detected that the belt mark 11*a* has passed the mark sensor 72, it is judged whether the combining mode is selected by the document mode selection button 232 and copy mode selection button 233 (step #204). When the combining mode is selected, the area mode is set to A (step #205) and the state counter is set to 1 (step #206). Thereafter, the flow is returned to the main routine. A procedure when the state counter is 1 is conducted at a next step. If the copy flag is not 1 in the step #202 or the mark sensor 72 is not on-edge in the step #203, no treatment is performed and the flow is returned to the main routine. when the combining mode is not selected in the step #204, general charging process is carried out (step #207) and the flow is returned to the main routine. When the state counter is 1, the charging flag is set to 1 to start charging (step #208), with the timer T1 being set to determine the charging time of the first document (step #209) and the state counter being set to 2 (step #210). The flow is then returned to the main routine and at a next routine a procedure when the state counter is 2 is started. When the state counter is 2, the timer T1 is checked if it is finished (step #211). In the cases where the timer T1 is not finished, the flow goes back to the main routine. If the timer T1 is finished, the charging flag is rest to 0 to end charging (step #213). The state counter is set to 3 (step #213) to return the flow to the main routine.

At a next routine starting when the state counter is 3, the state of the copy flag as well as whether the mark sensor 72 is on-edge is checked (steps #214, #215). If the copy flag is 1 and the mark sensor 72 is on-edge, the area mode is set to B (step #216), the timer T1 is set to determine the starting timing of charging of the second document (step #217) and the state counter is set to 4 (step #218). Thereafter, the flow is moved once to the main routine. If the copy flag is 0 or if the mark sensor 72 is not on edge, the flow is directly returned to the main routine without anything performed. When the state counter is 4, it is checked whether the time T1 is finished (step #219). When the timer T1 is not finished, the flow goes to the main routine. If the timer T1 is finished, the charging flag is set to 1 thereby to start charging of the second document (step #220). The timer T2 is set to determine the charging time (step #221) and the state counter is set to 5 (step #222). Then, the flow is moved back to the main routine. At a next routine when the state counter is 5, the timer T2 is checked whether it is finished (step #223). Without the timer T2 finished, the flow is returned to the main routine. However, when the timer T2 is finished, the charging flag is reset to 0 to terminate charging (step #224). At the same time, the state counter is reset to 0 (step #225) to return the flow to the main routine.

Figure 7A:
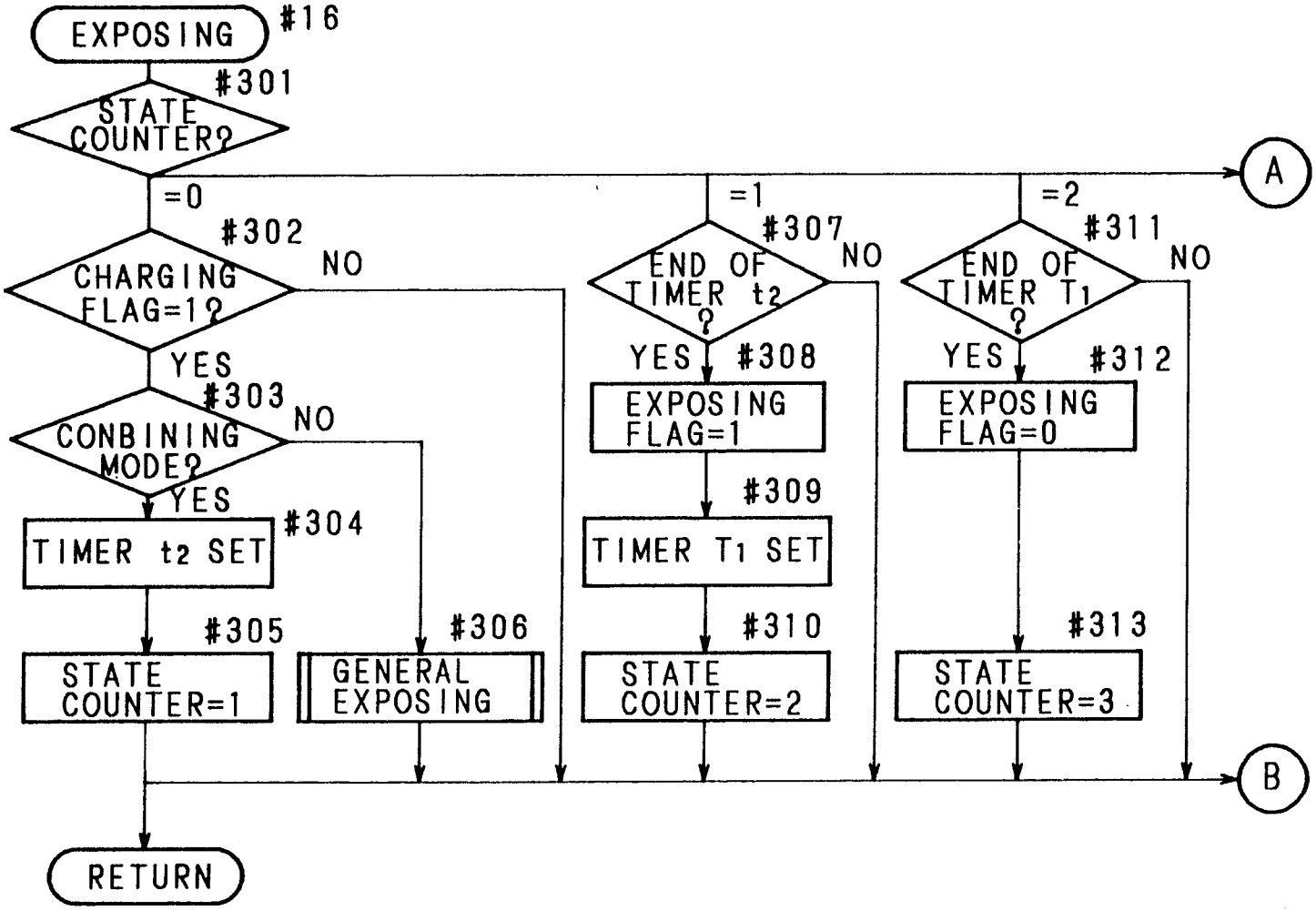
FIG. 7(*a*) and (*b*) are flow charts showing the content of the exposing process of FIG. 4.
Figure 7B:
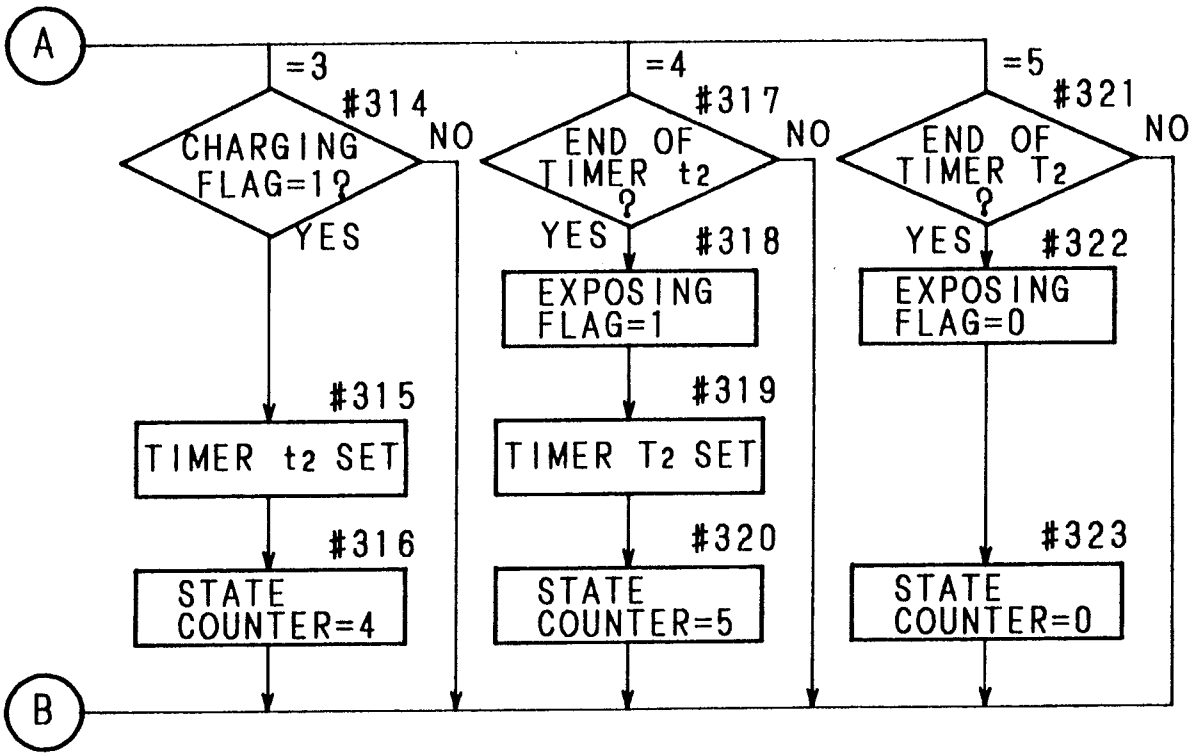

FIGS. 7(*a*), (*b*) are flow charts showing the content of the exposing process in the step #16. The value of the state counter (initial value 0) is first checked (step #301). If the state counter is 0, it is further checked whether the charging flag is 1, that is, whether the belt mark 11*a* is detected to start the charging process (step #302). In the case where the charging flag is not 1, the main routine is resumed. If the charging flag is 1, it is found whether the combining mode is selected (step #303). When the combining mode is selected, the timer t2 is set to determine the starting timing of exposure for the first document (step #304). In this case, the state counter is set to 1 (step #305), so that the flow is returned to the main routine. As a result, a procedure when the state counter is 1 is started at a next routine. If the combining mode is not selected in the step #303, general exposing process is carried out (step #306) and the flow is moved back to the main routine. When the state counter is 1, it is checked whether the timer t2 is terminated (step #307). If the timer t3 is not finished, the flow is returned to the main routine. In contrast, when the timer t2 is finished, the exposure flag is set to 1 thereby to start exposing (step #308). The timer T1 is set to set the exposing time (step #309) and then, the state counter is set to 2 (step #310). Subsequently, the flow moves back to the main routine. A procedure when the state center indicates 2 is processed at a next routine. It is first checked whether the timer T1 is finished (step #311) when the state counter is 2. If the timer T1 is finished, the exposing flag is reset to 0 so as to end the exposure (step #312). The state counter is set to 3 (step #313), with the flow once returning to the main routine. Thereafter, a procedure when the state counter is 3 is started at a next routine.

It is detected whether the charging flag is 1 when the state counter is 3 (step #314). If the charging flag is not 1, the main routine comes back. However, if the charging flag is 1 and the second document is already started to be charged, the timer t2 is set to determine the starting timing of exposure of the second document (step #315). Then, after the state counter is set to 4 (step #316), the flow is returned to the main routine. It is checked whether the timer t2 is finished when the state counter is 4 (step #317). If the timer t2 is not finished, the flow is returned to the main routine. If the timer t2 is finished, the exposing flag is set to 1 thereby to start exposing of the second document (step #318). The timer T2 is set to determine the exposing time (step #319). The state counter is set to 5 (step #320) to return the flow to the main routine. Then, a procedure when the state counter indicates 5 is carried out at a next routine. If the state counter indicates 5, it is checked whether the timer T2 is finished (step #321). In the case whether the timer T2 is not finished, the flow goes back to the main routine. When the timer T2 is finished, the exposing flag is reset to 0 to terminate the exposure (step #322). Then, the state counter is reset to 0 (step #323) and the flow is returned to the main routine.

Figure 8A:
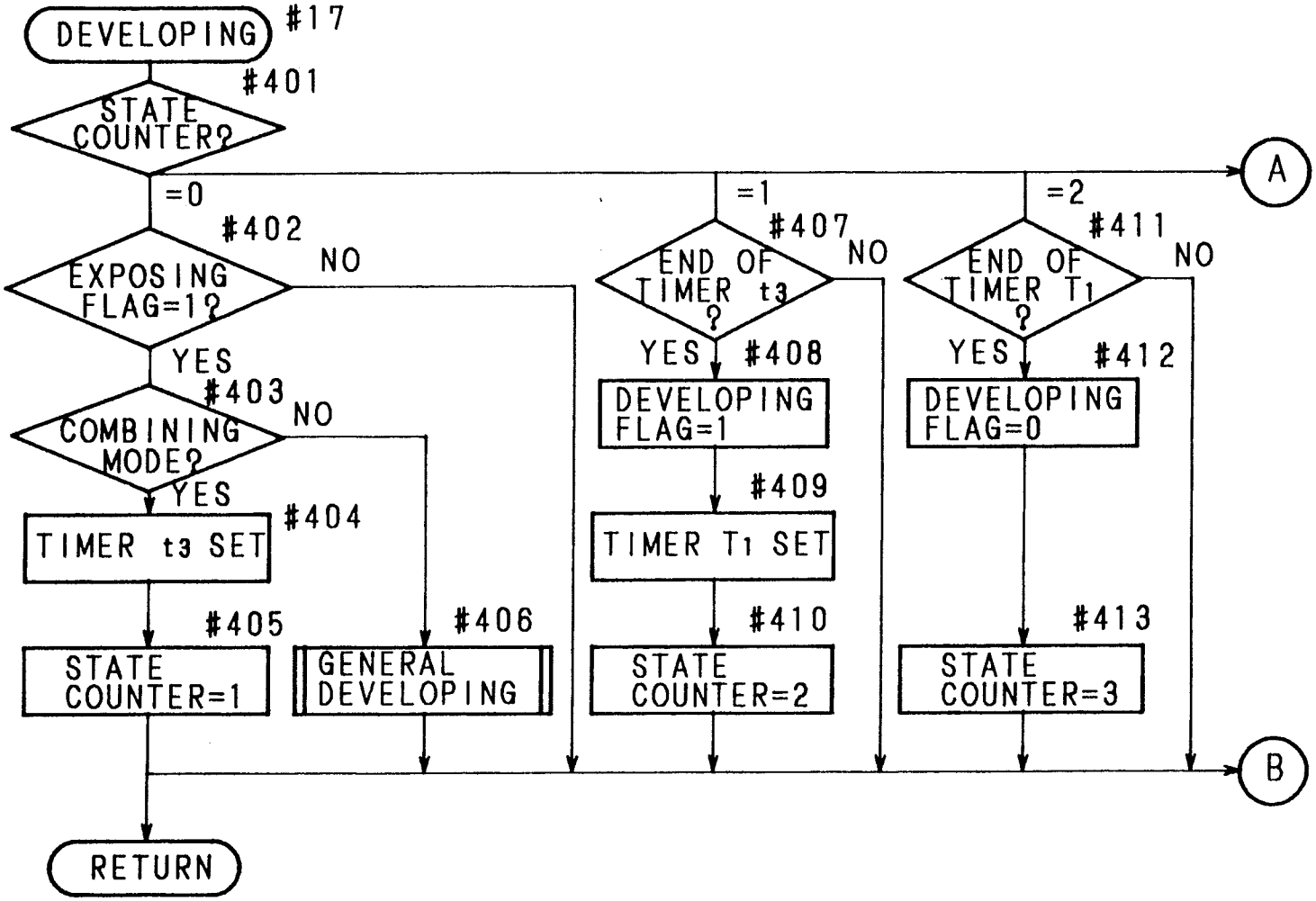
FIG. 8(*a*) and (*b*) are flow charts showing the content of the developing process of FIG. 4.
Figure 8B:
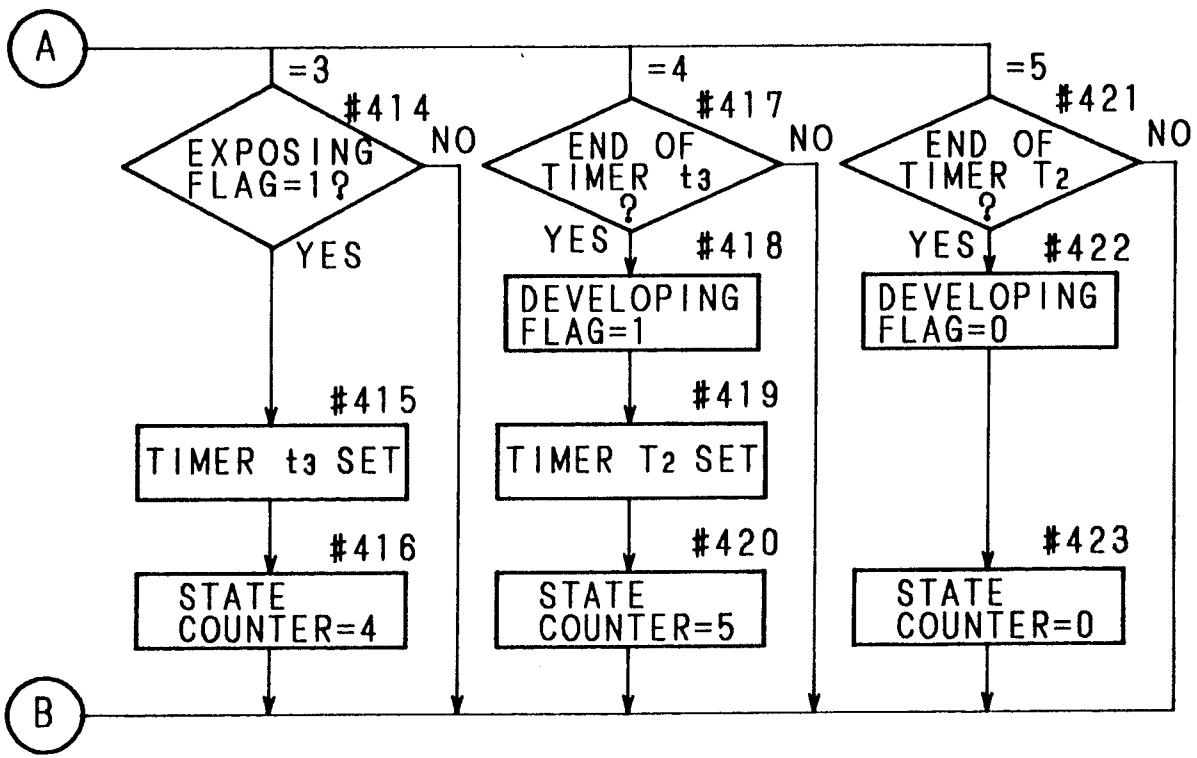

FIGS. 8(*a*), (*b*) are flow charts showing the content of the developing process in the step #17. The value of the state counter (initial value 0) is first checked (step #401). If the state counter is 0, it is further checked whether the exposing flag is 1, that is, whether the belt mark 11*a* is detected to start the exposing process (step #402). In the case where the charging flag is not 1, the main routine is resumed. If the exposing flag is 1, it is found whether the combining mode is selected (step #403). When the combining mode is selected, the timer t3 is set to determine the starting timing of developing for the first document (step #404). In this case, the state counter is set to 1 (step #405), so that the flow is returned to the main routine. As a result, a procedure when the state counter is 1 is started at a next routine. If the combining mode is not selected in the step #403, general developing process is carried out (step #406) and the flow is moved back to the main routine. When the state counter is 1, it is checked whether the timer t3 is terminated (step #307). If the timer t3 is not finished, the flow is returned to the main routine. In contrast, when the timer t3 is finished, the developing flag is set to 1 thereby to start exposing (step #408). The timer T1 is set to set the developing time (step #409) and then, the state counter is set to 2 (step #410). Subsequently, the flow moves back to the main routine. A procedure when the state center indicates 2 is processed at a next routine. It is first checked whether the timer T1 is finished (step #411) when the state counter is 2. If the timer T1 is finished, the developing flag is reset to 0 so as to end the developing (step #412). The state counter is set to 3 (step #413), with the flow once returning to the main routine. Thereafter, a procedure when the state counter is 3 is started at a next routine.

It is detected whether the exposing flag is 1 when the state counter is 3 (step #414). If the exposing flag is not 1, the main routine comes back. However, if the exposing flag is 1 and the second document is already started to be exposed, the timer t3 is set to determine the starting timing of developing of the second document (step #415). Then, after the state counter is set to 4 (step #416), the flow is returned to the main routine. It is checked whether the timer t3 is finished when the state counter is 4 (step #417). If the timer t3 is not finished, the flow is returned to the main routine. If the timer t3 is finished, the developing flag is set to 1 thereby to start developing of the second document (step #418). The timer T2 is set to determine the developing time (step #419). The state counter is set to 5 (step #420) to return the flow to the main routine. Then, a procedure when the state counter indicates 5 is carried out at a next routine. If the state counter indicates 5, it is checked whether the timer T2 is finished (step #421). In the case whether the timer T2 is not finished, the flow goes back to the main routine. When the timer T2 is finished, the developing flag is reset to 0 to terminate the developing (step #422). Then, the state counter is reset to 0 (step #423) and the flow is returned to the main routine.

Figure 9A:
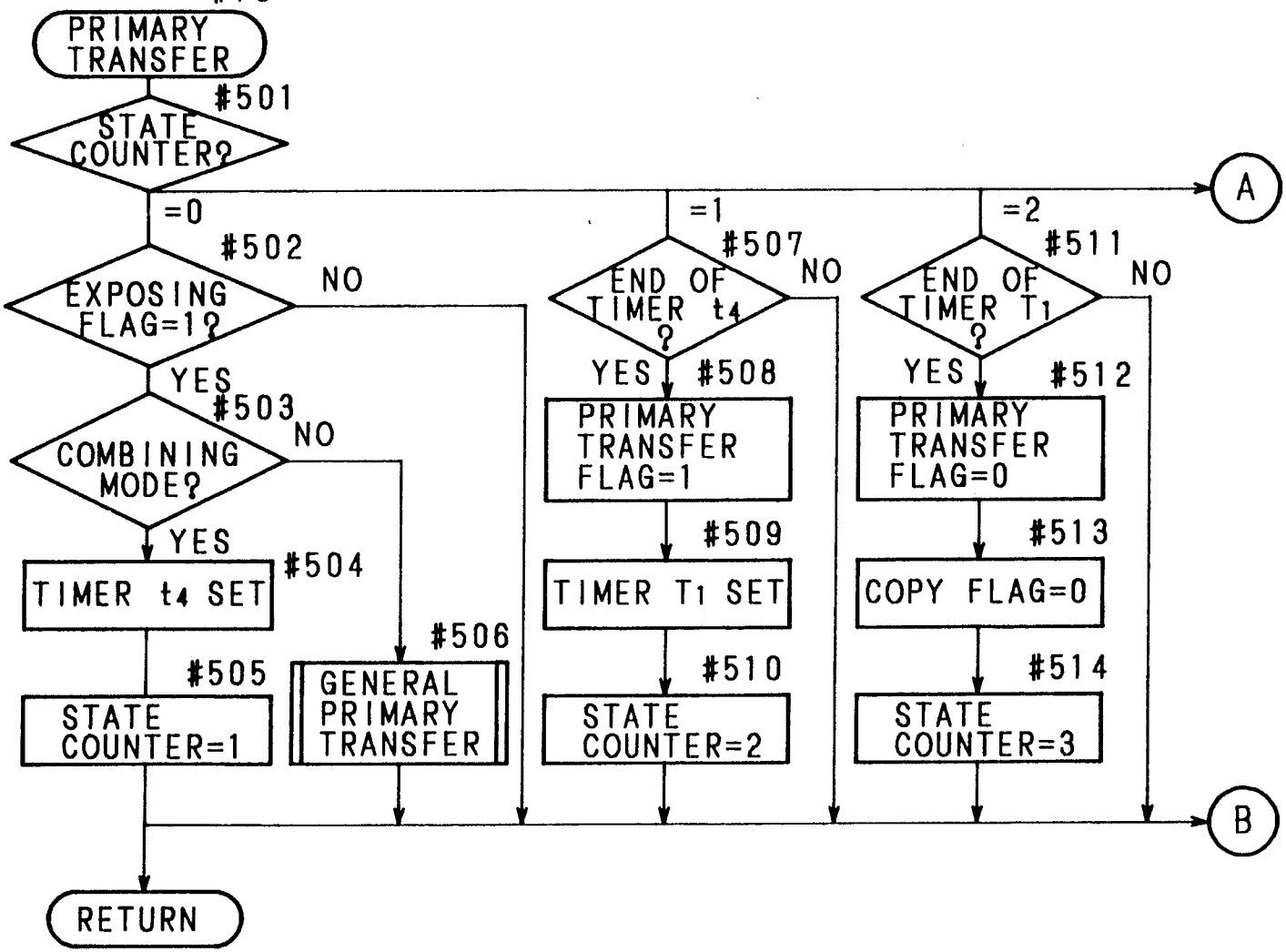
FIG. 9(*a*) and (*b*) are flow charts showing the content of the primary transfer process of FIG. 4.
Figure 9B:
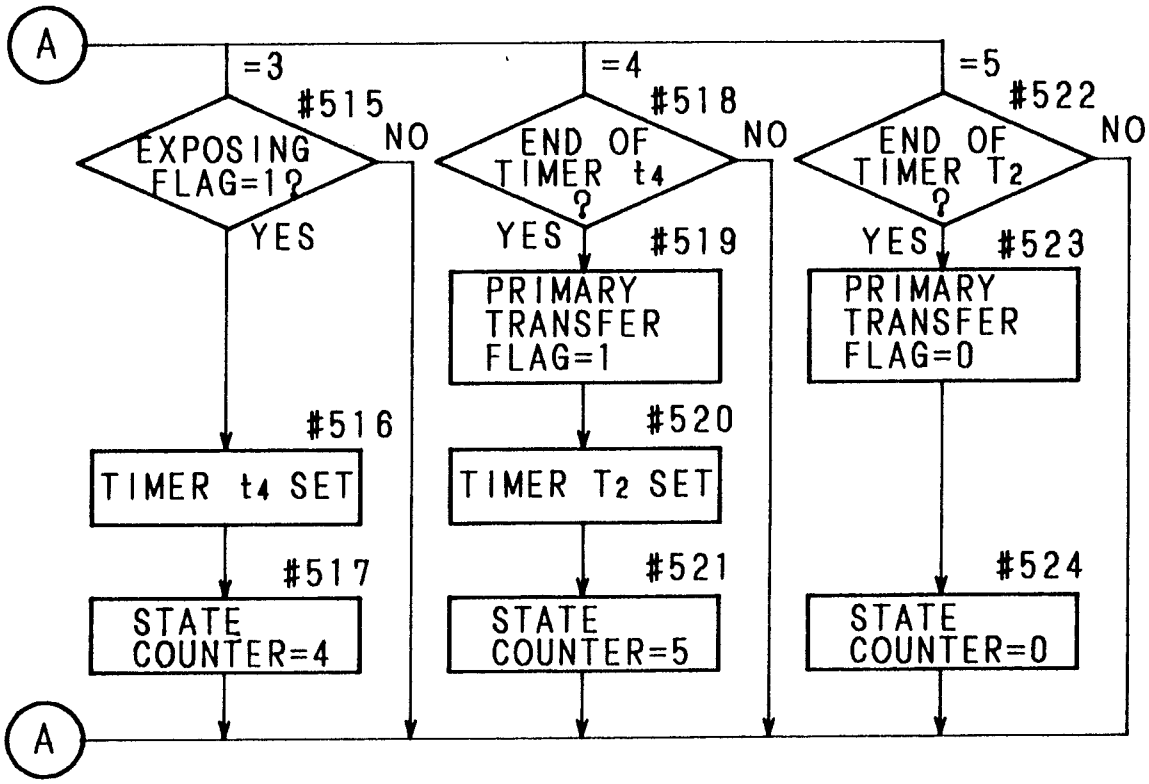

FIG. 9(*a*), (*b*) are flow charts showing the content of the primary transfer process in the step #18. The value of the state counter (initial value 0) is first checked (step #501). If the state counter is 0, it is further checked whether the exposing flag is 1, that is, whether the belt mark 11*a* is detected to start the exposing process (step #502). In the case where the exposing flag is not 1, the main routine is resumed. If the exposing flag is 1, it is found whether the combining mode is selected (step #503). When the combining mode is selected, the timer t4 is set to determine the starting timing of primary transfer for the first document (step #504). In this case, the state counter is set to 1 (step #505), so that the flow is returned to the main routine. As a result, a procedure when the state counter is 1 is started at a next routine. If the combining mode is not selected in the step #503, general primary transfer process is carried out (step #506) and the flow is moved back to the main routine. When the state counter is 1, it is checked whether the timer t4 is terminated (step #507). If the timer t4 is not finished, the flow is returned to the main routine. In contrast, when the timer t4 is finished, the primary transfer flag is set to 1 thereby to start primary transfer (step #508). The timer T1 is set to set the primary transfer time (step #509) and then, the state counter is set to 2 (step #510). Subsequently, the flow moves back to the main routine. A procedure when the state center indicates 2 is processed at a next routine. It is first checked whether the timer T1 is finished (step #511) when the state counter is 2. If the timer T1 is finished, the primary transfer flag is reset to 0 so as to end the primary transfer (step #512). The copy flag is reset to 0 so as to end the copying once (step #513). The state counter is set to 3 (step #514), with the flow once returning to the main routine. Thereafter, a procedure when the state counter is 3 is started at a next routine.

It is detected whether the exposing flag is 1 when the state counter is 3 (step #515). If the exposing flag is not 1, the main routine comes back. However, if the exposing flag is 1 and the second document is already started to be exposed, the timer t4 is set to determine the starting timing of primary transfer of the second document (step #516). Then, after the state counter is set to 4 (step #517), the flow is returned to the main routine. It is checked whether the timer t4 is finished when the state counter is 4 (step #518). If the timer t4 is not finished, the flow is returned to the main routine. If the timer t4 is finished, the primary transfer flag is set to 1 thereby to start primary transfer of the second document (step #519). The timer T2 is set to determine the primary transfer time (step #520). The state counter is set to 5 (step #521) to return the flow to the main routine. Then, a procedure when the state counter indicates 5 is carried out at a next routine. If the state counter indicates 5, it is checked whether the timer T2 is finished (step #522). In the case whether the timer T2 is not finished, the flow goes back to the main routine. When the timer T2 is finished, the primary transfer flag is reset to 0 to terminate the primary transfer (step #523). Then, the state counter is reset to 0 (step #524) and the flow is returned to the main routine.

Figure 10:
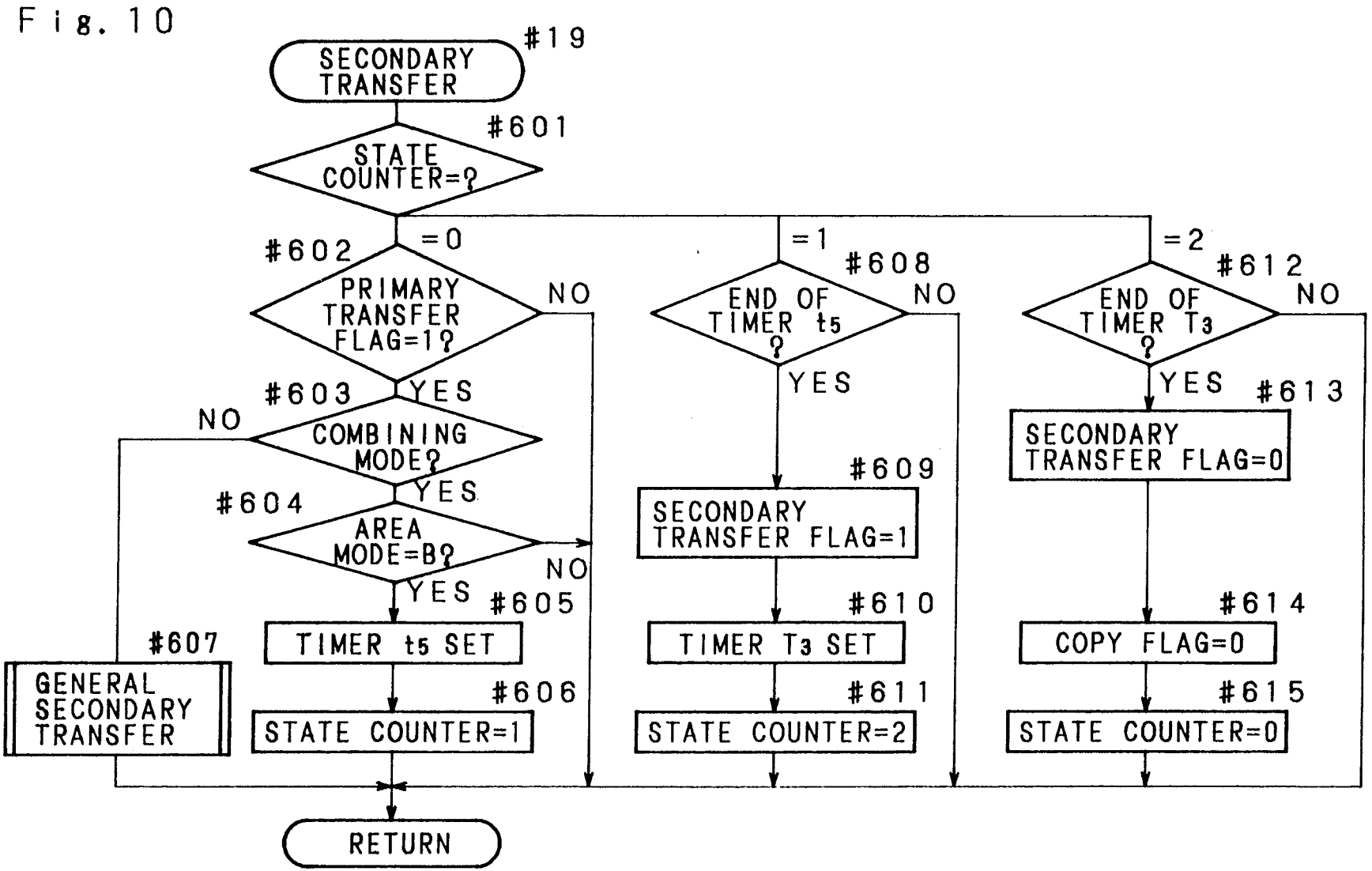
FIG. 10 is a flow chart showing the content of the secondary transfer process of FIG. 4.

A flow chart of FIG. 10 shows the content of the secondary transfer process in the step #19. In the first place, the value of the state counter (initial value 0) is checked (step #601). Then, it is checked whether or not the first transfer flag is 1, i.e., whether the first transfer is started (step #602). When the first transfer flag is 1, it is detected whether the combining mode is selected (step #603). IF the combining mode is selected, it is checked whether the area mode is B, that is, whether it is a mode to be scanned by the scanner 30 from the position of the simultaneous switch 103 to the rear end of the image (step #604). When the area mode is B, the timer t5 is set to determine the starting timing of the secondary transfer (step #605), with the state counter being set to 1 (step #606) and the flow returned to the main routine. If the first transfer flag is not 1, or if the area mode is not B, the flow is moved directly to the main routine. Moreover, if the combining mode is not selected, general secondary transfer is conducted (step #607) and the flow is brought back to the main routine.

When the state counter is 1, at a next routine, the timer t5 is checked if it is finished (step #608). The flow is returned to the main routine if the timer t5 is not finished. On the other hand, the secondary transfer flag is set to 1 to start the secondary transfer when the timer t5 is finished (step #609). In this case, the timer T3 is set to decide the timer of the secondary transfer (step #610) and the state counter is set to 2 (step #611). Then, the flow is once returned to the main routine. According to a next routine, when the state counter shows 2, the termination of the timer T3 is checked (step #612). In the case where the timer T3 is not finished, the main routine is recovered. On the other hand, if the timer T3 is finished, the secondary transfer flag is reset to 0 to end the secondary transfer (step #613). The copy flag is reset to 0 thereby to finish copying (step #614). Then, the state counter is reset to the initial value 0 (step #615), thereby returning the flow to the main routine.

Figure 11:
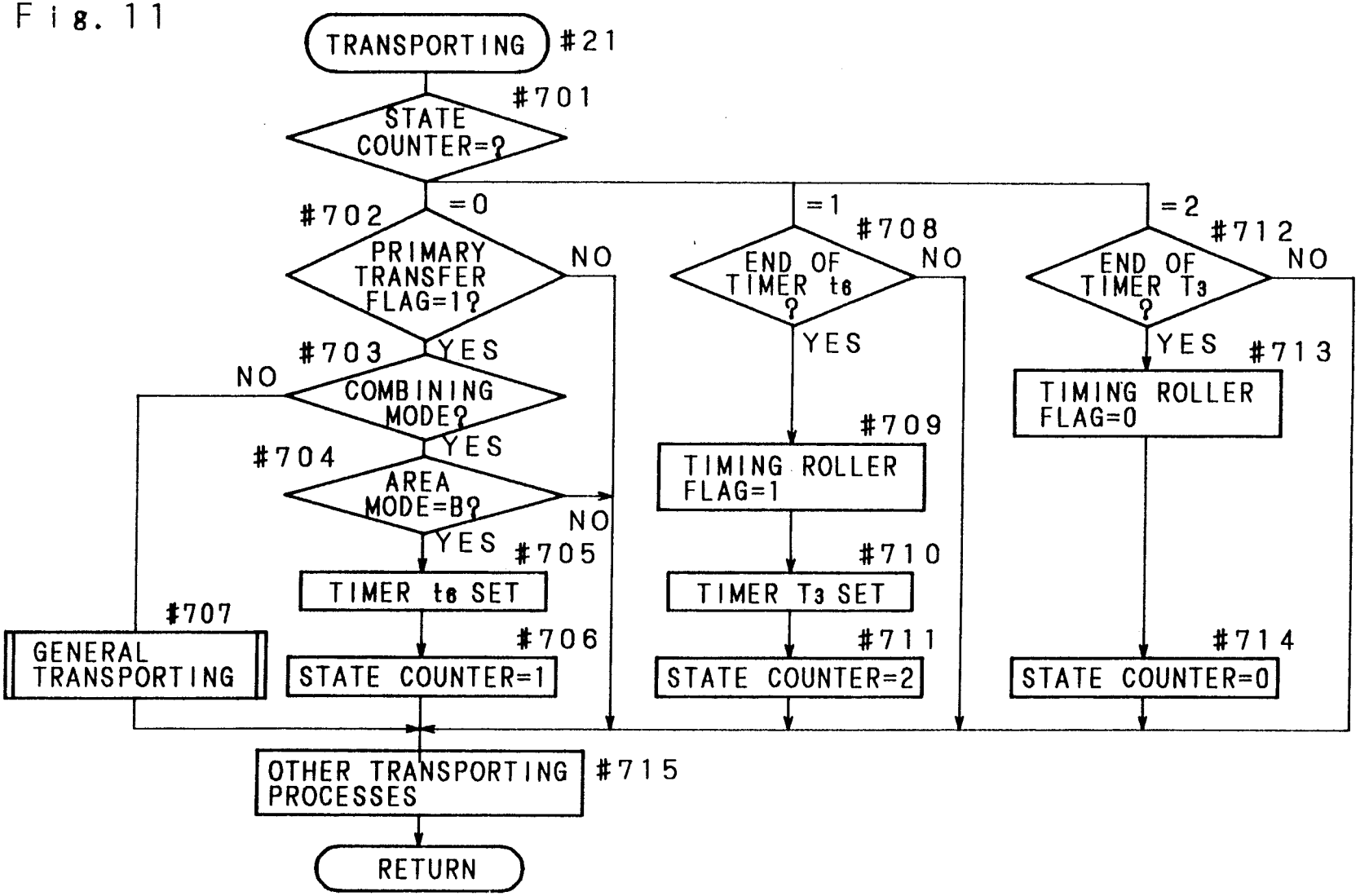
FIG. 11 is a flow chart showing the content of the transporting process of FIG. 4.

A flow chart of FIG. 11 shows the content of the transporting process in the step #21. In the first place, the value of the state counter (initial value 0) is checked (step #701). Then, it is checked whether or not the primary transfer flag is 1 (step #702). When the primary transfer flag is 1, it is detected whether the combining mode is selected (step #703). If the combining mode is selected, it is checked whether the area mode is B (step #704). When the area mode is B, the timer t6 is set to determine the starting timing of the transporting from the timing roller 46 (step #705), with the state counter being set to 1 (step #706) and the other transporting procedures being conducted (step #715) and the flow returned to the main routine. If the first transfer flag is not 1, or if the area mode is not B, the flow is moved directly to the main routine. Moreover, if the combining mode is not selected, general transporting is conducted (step #707) and the flow is brought back to the main routine.

When the state counter is 1, at a next routine, the timer t6 is checked if it is finished (step #708). The flow is returned to the main routine if the timer t6 is not finished. On the other hand, the timing roller flag is set to 1 to start the transporting of paper P by turning the timing roller clutch 46*a* ON when the timer t6 is finished (step #709). In this case, the timer T3 is set to decide the timer of the transporting by the timing roller 46 (step #710) and the state counter is set to 2 (step #711). The flow advances to step #715, and the flow is once returned to the main routine. According to a next routine, when the state counter shows 2, the termination of the timer T3 is checked (step #712). In the case where the timer T3 is not finished, the main routine is recovered. On the other hand, if the timer T3 is finished, the timing roller flag is reset to 0 to end the transporting by the timing roller 46 by turning the timing roller clutch 46*a* OFF (step #713). The state counter is reset to the initial value 0 (step #714). The flow advances to step #715 and returns to the main routine.

Figure 12:
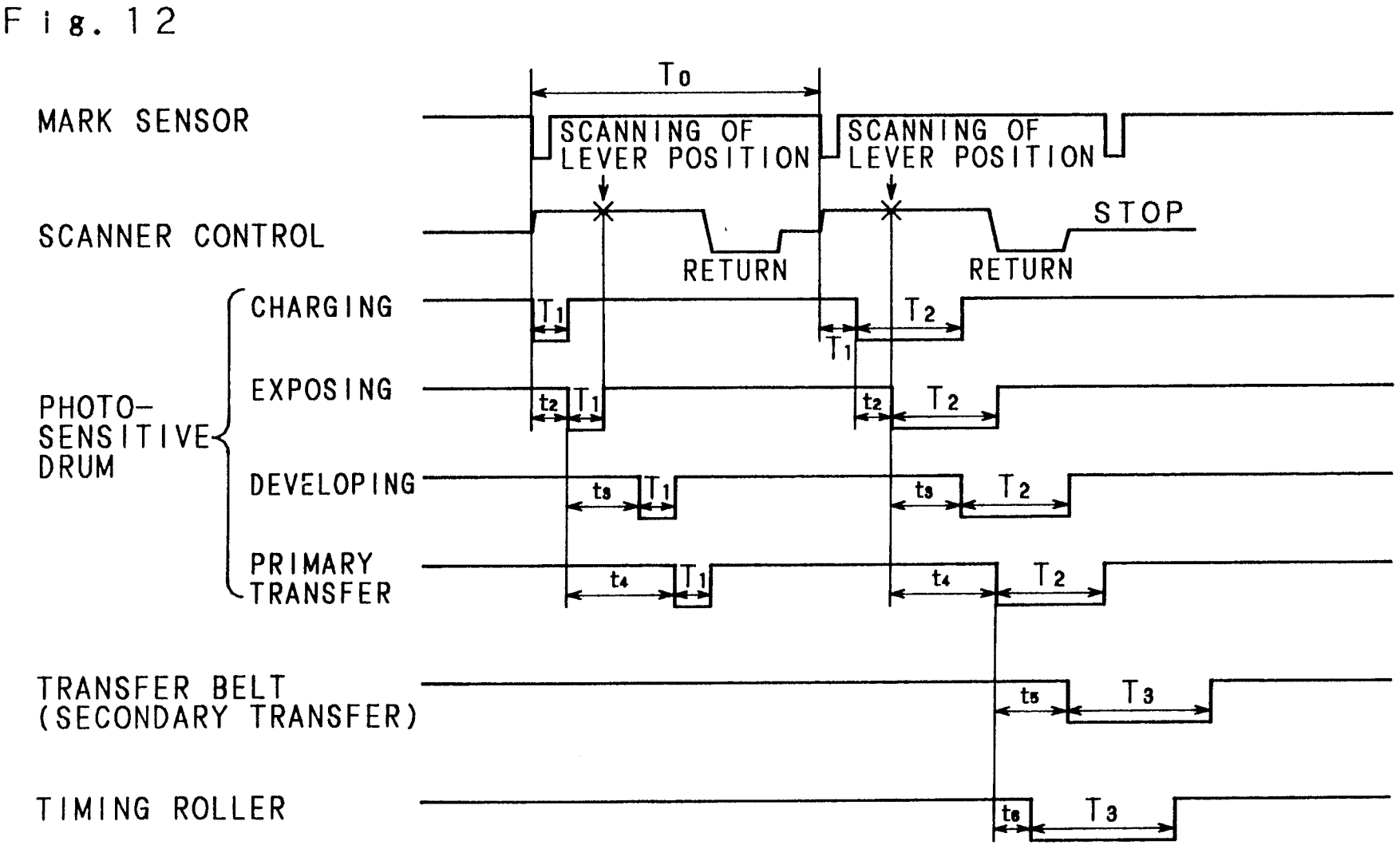
FIG. 12 is a timing chart of the combining copy mode.

Now, how to control each element to achieve the combining copy mode which is the main concept of this invention will be depicted with reference to a flow chart of FIG. 12.

When the first document is set and the print switch 200 is depressed in the combining copy mode set by the document selection button 232 and copy mode selection button 233, pre-scanning is carried out to detect the position of the simultaneous lever 102. Subsequently, the belt mark 11*a* on the transfer belt 11 is detected. A part of the photosensitive drum 3 corresponding to the image section from the front end of the image to the position of the simultaneous lever 102 is charged for T1 seconds. The time T1 is calculated based on the position of the simultaneous lever 102 (which is variable) detected at the pre-scanning time and the timer t2 (which is fixed). Then, the exposure is started with a delay of time set by the timer t2 while the photosensitive drum 3 moves from the charging point to the exposing point and, the developing and first transfer are performed with delay of t3 seconds and t4 seconds, respectively. Accordingly, the image from the front end of the first document to the position of the simultaneous lever 102 is transferred (primary transfer) to the transfer belt 11.

The document is exchanged with a second sheet. After the timer T1, in order to transfer an image from the position of the simultaneous lever 102 to the rear end of the image to the transfer belt 11, the part from the position of the simultaneous lever 102 to the rear end of the image is charged for T2 seconds, exposed with a delay of t2 seconds, developed with a delay of t3 seconds and transferred (primary transfer) with a delay of t4 seconds. In the above manner, the image from the position of the simultaneous lever 102 to the rear end of the second document is transferred (primary transfer) to the transfer belt 11. In other words, there are transferred (primary transfer) to the transfer belt 11 according to the above-described sequence of the procedures both the image in the section of the area mode A of the first document, i.e., from the front end to the simultaneous lever 102, and the image in the section of the area mode B of the second document, that is, from the simultaneous lever 102 to the rear end.

If these images are transferred (secondary transfer) to a paper P at once, a copy of predetermined portions extracted from a plurality of documents can be obtained.

Figure 13A:
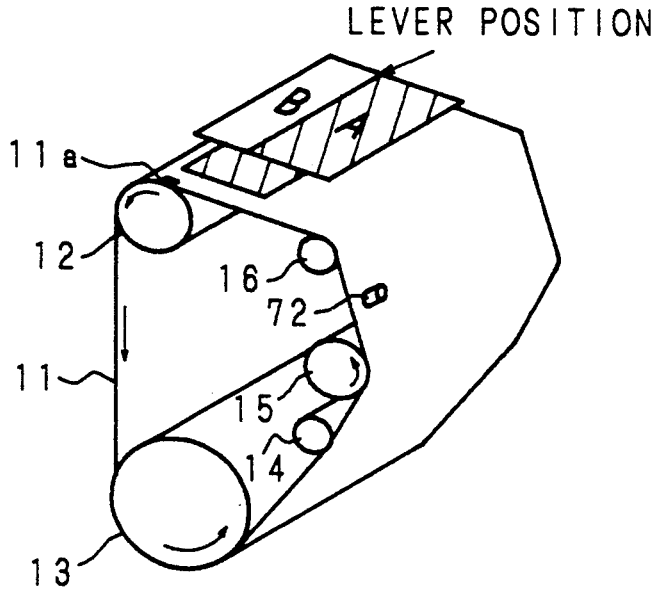
FIGS. 13(*a*), (*b*), and (*c*) are perspective views of the state in the combining copy mode.
Figure 13B:
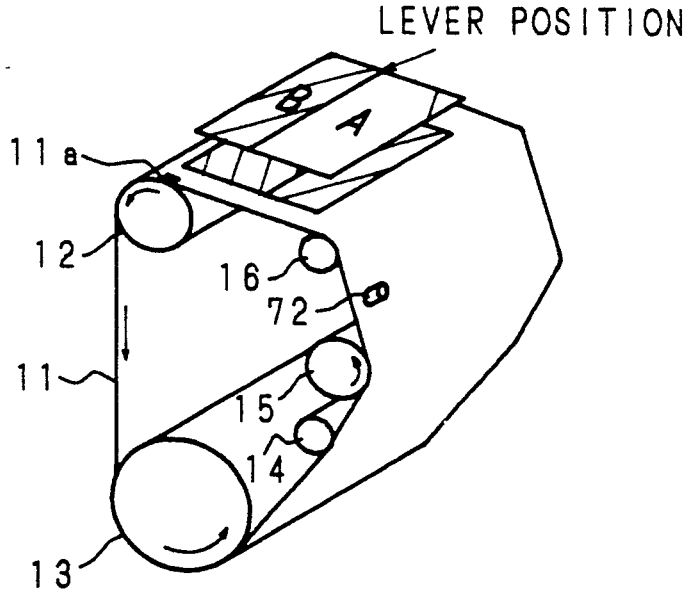
Figure 13C:
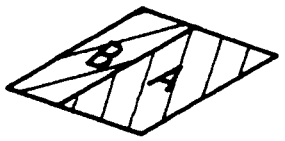

In FIG. 13, a toner image on the transfer belt 11 and a copied output of in relation to the document and the position of the simultaneous lever 102 is illustrated. Referring to FIG. 13(*a*), a toner image of the section in the area mode A of the document set by the simultaneous lever 102 is held on the transfer belt 11. In FIG. 13(*b*), similarly, a toner image of the section in the area mode B of the document designated by the simultaneous lever 102 is held along with the toner image of FIG. 13(*a*) on the transfer belt 11. In FIG. 13(*c*), predetermined sections of a plurality of documents are outputted as one copy by transferring the toner images in the area modes A, B held on the transfer belt 11 to the paper at one time.

According to the present embodiment, an intermediate transfer body, namely, transfer belt is used to obtain a clear image. Since the surface of the photosensitive body should be uniformly charged so as to obtain a clear image, it is necessary to completely remove the electric charges of the photosensitive body by the main eraser and to start charging earlier than the exposing point. If the image is held on the photosensitive body, however, since the toners statically adhered to the photosensitive body may be disadvantageously separated due to the removal of the electric charges or excessively charged, such a drawback is brought about that the image held on the photosensitive body be developed again. As such, it is considerably difficult to control charging, developing and erasing for every minute section when the photosensitive body is used. And, if the images are to be overlapped each other on the photosensitive body, the image section formed in the first process is undesirably charged, developed and erased in the next process, resulting in an unclear image at the boundary of the image sections. In contrast, if the images are to be overlapped each other on the transfer belt, since the image formation is carried out at the photosensitive body, the image is clear even at an end part thereof. Moreover, since the transfer is carried out at one time by the secondary transfer, an image clear even at the boundary is transferred to the paper.

This invention is not limited to the aforementioned example, but is applicable to a general copying machine without using a transfer belt. In such case, a cleaning device should be arranged to be selectively in pressed contact with and detached from the photosensitive body. The cleaning device should be separated from the photosensitive drum after the document is developed so as to prevent the toners on the photosensitive body from being removed, and pressed against the photosensitive drum after the other document is developed and transferred.

Furthermore, although the image section is divided into two by one simultaneous lever according to the above embodiment, it is needless to say that a plurality of simultaneous levers may possibly be provided to divide the image section into two or more thereby to obtain a combined copy.

As this invention may be embodied in several forms without departing from the spirit of essential characteristics thereof, the present embodiment is therefore illustrative and not restrictive, since the scope of the invention is misdefined by the appended claims rather than by the description preceding them, and all changes that fall within the metes and bounds of the claims, or equivalence of such metes and bounds thereof are therefore intended to be embraced by the claims.

What is claimed is:

1. An image forming apparatus, comprising:

first image holding means for holding an image;

image forming means for forming an image on said first image holding means;

second image holding means for holding the image which is transferred from said first image holding means thereto;

designating means for designating image sections to be transferred to said second image holding means for each of a plurality of images formed on said first image holding means;

control means for controlling so that a plurality of image sections designated by said designating means are transferred to and combined on said second image holding means; and means for transferring the combined image on said second image holding means to a paper.

2. An image forming apparatus, comprising:

first image holding means for holding an image;

image forming means for forming an image on said first image holding means;

second image holding means for holding the image which is transferred from said first image holding means thereto;

designating means for designating two image sections to be transferred to said second image holding means for each of a first and a second images formed on said first image holding means;

control means for controlling so that the two image sections designated by said designating means are transferred to and combined on said second image holding means; and means for transferring the combined image on said second image holding means to a paper.

3. An image forming apparatus, comprising:

scanning means for exposing/scanning a document in relative movement with said document;

designating means for designating the position of the boundary to divide said document in the scanning direction into (n) sections (n: a natural number not smaller than 2);

first image holding means for holding an image;

image forming means for forming an image of the document exposed/scanned by said scanning means on said first image holding means;

second image holding means for holding an image;

first transfer means for transferring the image held by said first image holding means to said second image holding means;

second transfer means for transferring the image held by said second image holding means to a transfer object; and control means for controlling so that when said document is exposed/scanned by said scanning means, a step to form an image of the (i)th section of the document ($1 \leqq i \leqq n$) on said first image holding means by said image forming means and a step to transfer the image of the (i)th section held by said first image holding means to said second image holding means by said first transfer means are alternately repeated every (n) times, and the images of (n) sections held by said second image holding means are transferred at once to said transfer object by said second transfer means.

4. An image forming apparatus, comprising:

scanning means for exposing/scanning a document in relative movement with said document;

designating means for designating the position of the boundary to divide said document in the scanning direction into a first and a second sections;

first image holding means for holding an image;

image forming means for forming an image of the document exposed/scanned by said scanning means on said first image holding means;

second image holding means for holding an image;

first transfer means for transferring the image held by said first image holding means to said second image holding means;

second transfer means for transferring the image held by said second image holding means to a transfer object; and control means for controlling:

the forming of an image of a document by said image forming means on said first image holding means while exposing/scanning said document by said scanning means;

the transfer of the image of the first section held by said first image holding means to said second image holding means by said first transfer means;

the forming of an image of the document by said image forming means on said first image holding means while exposing/scanning said document by said scanning means;

the transfer of the image of the second section held by said first image holding means to said second image holding means by said first transfer means; and the transfer of the images of the first and second sections held by said second image holding means at once to said transfer object by said second transfer means.

5. An image forming apparatus according to claim 4, wherein said designating means has a lever movable along the scanning direction of said document.

6. An image forming apparatus according to claim 4, further comprising detecting means for detecting that said second image holding means is at a predetermined position.

7. An image forming apparatus according to claim 6, wherein said control means controls said scanning means to start exposing/scanning when said detecting means detects that said second image holding means is at the predetermined position.

8. An image forming apparatus according to claim 6, wherein said first transfer means is switched between an operative state to perform transfer and an inoperative state not to perform transfer, and said control means controls the operative and inoperative states of said first transfer means based on the detecting result of said detecting means and designation of said designating means.

9. An image forming apparatus comprising:

a photosensitive member;

a platen for holding original sheets;

designating means for designating a first area and a second area of said original sheets held by said platen;

scanning means for scanning said original sheets held by said platen and forming images of said original sheets on said photosensitive member, wherein a first image corresponding to said first area is formed on said photosensitive member at a first scanning operation of said scanning means, and a second image corresponding to said second area is formed on said photosensitive member which the first image is formed on at a second scanning operation;

a transfer member for receiving said first and second images from said photosensitive member to combine the first and second images therein; and transfer means for transferring the combined image from said transfer member to a paper.

10. An image forming method comprising the steps of:

designating a first area and a second area of an original;

scanning a first original to form a first image corresponding to said first area of the first original on a photosensitive member;

transferring the first image from the photosensitive member to a transfer member;

scanning a second original to form a second image corresponding to said second area of the second original on the photosensitive member;

transferring the second image from the photosensitive member to the transfer member which the first image is formed on to combine the first and second images on the transfer member; and transferring the combined image from the transfer member to a paper.

* * * * *